US011112718B2

(12) United States Patent
Uno et al.

(10) Patent No.: US 11,112,718 B2
(45) Date of Patent: Sep. 7, 2021

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masashi Uno, Mishima (JP); Fumihiko Utsuno, Suntou-gun (JP); Hideya Arimura, Shizuoka (JP); Hiroaki Komatsu, Fuji (JP); Masaki Yamada, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 450 days.

(21) Appl. No.: 16/139,437

(22) Filed: Sep. 24, 2018

(65) Prior Publication Data

US 2019/0094741 A1 Mar. 28, 2019

(30) Foreign Application Priority Data

Sep. 27, 2017 (JP) ..... JP2017-186668

(51) Int. Cl.
*G03G 15/02* (2006.01)
*G03G 15/16* (2006.01)
(Continued)

(52) U.S. Cl.
CPC ..... *G03G 15/0233* (2013.01); *G03G 5/043* (2013.01); *G03G 5/0567* (2013.01); *G03G 5/0571* (2013.01); *G03G 5/0575* (2013.01); *G03G 5/0589* (2013.01); *G03G 5/1476* (2013.01); *G03G 5/14765* (2013.01); *G03G 5/14769* (2013.01); *G03G 5/14786* (2013.01); *G03G 5/14791* (2013.01); *G03G 5/14795* (2013.01); *G03G 15/0818* (2013.01);
(Continued)

(58) Field of Classification Search
None
See application file for complete search history.

(56) References Cited

U.S. PATENT DOCUMENTS 4,960,849 A 10/1990 Okabe et al.
5,925,893 A * 7/1999 Ishii ..... C08G 18/0819 257/40

(Continued)

FOREIGN PATENT DOCUMENTS

| | | | |
|---|---|---|---|
| JP | S63-235320 | A | 9/1988 |
| JP | 2006-133257 | A | 5/2006 |
| JP | 2011-118113 | A | 6/2011 |

OTHER PUBLICATIONS

Morrison Boyd, "Organic Chemistry vol. 1, sixth edition", pp. 310-311, Tokyo Kagaku Dojin (1994) . Specification paragraph No. [0055].

*Primary Examiner* — Ramsey Zacharia
(74) *Attorney, Agent, or Firm* — Venable LLP

(57) ABSTRACT

Provided is an electrophotographic member in which the increase in tackiness is small even in an environment of high temperature and high humidity. The electrophotographic member includes an electroconductive substrate and a surface layer, the surface layer contains resin including at least one of a urethane bond and an amide bond, the resin includes a cationic structure and an anionic structure in a molecule, and also includes a particular main-chain structure with hydrophobicity.

6 Claims, 6 Drawing Sheets

(51) Int. Cl.

| | |
|---|---|
| ***G03G 5/043*** | (2006.01) |
| ***G03G 5/05*** | (2006.01) |
| ***G03G 5/147*** | (2006.01) |
| ***G03G 21/00*** | (2006.01) |
| ***G03G 15/08*** | (2006.01) |

(52) U.S. Cl.
CPC ..... *G03G 21/0017* (2013.01); *G03G 15/0808* (2013.01); *G03G 15/1685* (2013.01); *G03G 2221/183* (2013.01)

(56) References Cited

U.S. PATENT DOCUMENTS

| | | | | |
|---|---|---|---|---|
| 5,956,555 | A * | 9/1999 | Chen | G03G 15/2057 399/329 |
| 7,797,833 | B2 | 9/2010 | Nakamura et al. | |
| 7,799,398 | B2 | 9/2010 | Nakamura et al. | |
| 8,600,273 | B2 | 12/2013 | Yamada et al. | |
| 8,655,222 | B2 | 2/2014 | Nakamura et al. | |
| 8,655,238 | B2 | 2/2014 | Uno et al. | |
| 8,706,011 | B2 | 4/2014 | Anan et al. | |
| 8,768,226 | B2 | 7/2014 | Koyanagi et al. | |
| 8,768,227 | B2 | 7/2014 | Urushihara et al. | |
| 8,774,677 | B2 | 7/2014 | Sakurai et al. | |
| 8,798,508 | B2 | 8/2014 | Yamada et al. | |
| 8,837,985 | B2 | 9/2014 | Ishida et al. | |
| 8,846,287 | B2 | 9/2014 | Kamada et al. | |
| 8,874,007 | B2 | 10/2014 | Kawamura et al. | |
| 8,874,012 | B2 | 10/2014 | Kamada et al. | |
| 8,913,930 | B2 | 12/2014 | Ishii et al. | |
| 9,581,931 | B2 | 2/2017 | Yamada et al. | |
| 9,599,913 | B2 | 3/2017 | Nishioka et al. | |
| 9,639,009 | B2 | 5/2017 | Yamaguchi et al. | |
| 9,665,028 | B2 | 5/2017 | Arimura et al. | |
| 9,811,009 | B2 | 11/2017 | Yamada et al. | |
| 9,977,353 | B2 | 5/2018 | Nishioka et al. | |
| 9,977,359 | B2 | 5/2018 | Koyanagi et al. | |
| 10,018,934 | B2 | 7/2018 | Yamada et al. | |
| 2013/0164038 | A1 | 6/2013 | Kusaba et al. | |
| 2013/0266339 | A1 | 10/2013 | Sugiyama et al. | |
| 2015/0331339 | A1 | 11/2015 | Yamada et al. | |
| 2015/0331341 | A1 | 11/2015 | Yamaguchi et al. | |
| 2015/0331342 | A1 | 11/2015 | Yamaguchi et al. | |
| 2015/0331346 | A1 | 11/2015 | Yamauchi et al. | |
| 2016/0187809 | A1 | 6/2016 | Yamaguchi et al. | |
| 2016/0363881 | A1 | 12/2016 | Urushihara et al. | |
| 2017/0060007 | A1 | 3/2017 | Yamada et al. | |
| 2017/0329251 | A1 | 11/2017 | Urushihara et al. | |
| 2018/0011418 | A1 | 1/2018 | Arimura et al. | |
| 2018/0039200 | A1 | 2/2018 | Utsuno et al. | |
| 2018/0217551 | A1 | 8/2018 | Arimura et al. | |

* cited by examiner

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member used for an electrophotographic apparatus, and a process cartridge and an electrophotographic apparatus that include the electrophotographic member.

Description of the Related Art

An electrophotographic image forming apparatus includes electrophotographic members such as a charging member, a developing member, and a developing blade. These electrophotographic members are required to have lower stickiness (hereinafter also referred to as tackiness) on their surfaces because these members are brought into direct contact with toner. According to Japanese Patent Application Laid-Open No. 2006-133257, the tackiness is decreased by increasing the cross-linking density of resin.

SUMMARY OF THE INVENTION

One aspect of the present invention is directed to providing an electrophotographic member including a surface layer that can have low tackiness and excellent flexibility. Further aspect of the present invention is directed to providing an electrophotographic apparatus that can stably output an electrophotographic image with high quality. Still further aspect of the present invention is directed to providing a process cartridge which can provide high quality electrophotographic image stably.

According to one aspect of the present invention, there is provided an electrophotographic member including an electroconductive substrate and a surface layer, wherein the surface layer contains resin including at least one of a urethane bond and an amide bond, the resin includes a cationic structure and an anionic structure in a molecule, and the resin includes at least one structure selected from the group consisting of structures expressed by (Structural Formula 1) to (Structural Formula 4):

$$-(CH_2-CR1=CH-CH_2)- \quad \text{(Structural Formula 1)}$$

(where R1 represents a hydrogen atom or a methyl group), $$-(R2\text{-}O)- \quad \text{(Structural Formula 2)}$$

(where R2 represents an alkylene group with 5 or more and 14 or less carbons), (Structural Formula 3)

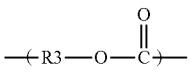

(where R3 represents an alkylene group with 5 or more and 14 or less carbons), and (Structural Formula 4)

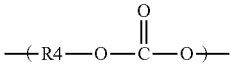

(where R4 represents an alkylene group with 6 or more and 14 or less carbons).

According to another aspect of the present invention, there is provided a process cartridge configured to be detachably attachable to a main body of an electrophotographic apparatus, the process cartridge including at least one member selected from the group consisting of a charging member, a developing member, a toner-supplying member, and a cleaning member, wherein the member includes the above electrophotographic member.

According to still another aspect of the present invention, there is provided an electrophotographic apparatus including at least one member selected from the group consisting of a charging member, a developing member, a toner-supplying member, and a cleaning member, wherein the member includes the above electrophotographic member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to a technique of Japanese Patent Application Laid-Open No. 2006-133257, the tackiness of the surface of the electrophotographic member can be decreased; however, in this case, the hardness increases. The electrophotographic member to be in direct contact with toner is preferably flexible from the viewpoint of suppressing the toner deterioration. In view of this, the present inventors have considered that it is necessary to develop a technique to obtain the electrophotographic member by decreasing the tackiness of the surface by other method than increasing the cross-linking density because increasing the cross-linking density results in the higher hardness.

The present inventors have intensively examined in order to obtain the electrophotographic member including the surface layer having both the low tackiness and the excellent flexibility. As a result, it has been found out that a resin material in which ionic bond cross linking is formed by having a cation structure and an anion structure in resin including at least one of an amide bond and a urethane bond with a particular hydrophobic main chain structure is effective in achieving the electrophotographic member with the characteristics as above.

An electrophotographic member according to one aspect of the present invention will hereinafter be described.

The electrophotographic member is a member that is used for an electrophotographic image forming apparatus and may be in contact with toner, and examples of the electrophotographic member include a developing roller, a toner-supplying roller, a developing blade, a charging roller, and a cleaning blade.

Note that the developing roller is an electrophotographic member to develop a latent image of an electrophotographic photosensitive member by toner that the developing roller carries. The toner-supplying roller is an electrophotographic member to supply toner to the developing roller. The developing blade is an electrophotographic member to restrict the thickness of a toner layer on the developing roller. The charging roller is an electrophotographic member to charge a surface of an electrophotographic photosensitive member. The cleaning blade is an electrophotographic member to clean the surface of the electrophotographic photosensitive member.

(Developing Roller, Toner-Supplying Roller, and Charging Roller)

Figure 1A:
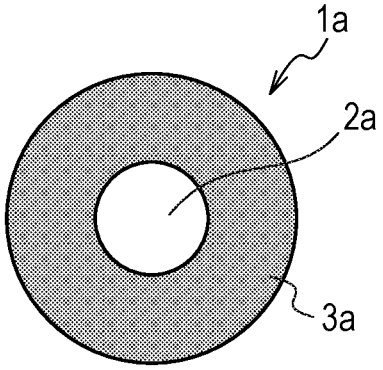
FIG. 1A is a schematic cross-sectional view of an electrophotographic member according to one aspect of the present invention.
Figure 1B:
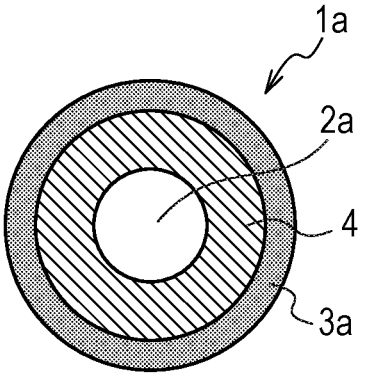
FIG. 1B is a schematic cross-sectional view of an electrophotographic member according to another aspect of the present invention.

One embodiment in which the electrophotographic member according to the present aspect is used as the developing roller, the toner-supplying roller, or the charging roller (hereinafter these are referred to as electrophotographic rollers) is illustrated in FIG. 1A and FIG. 1B. As illustrated in FIG. 1A, an electrophotographic roller 1*a* includes an electroconductive substrate 2*a* and a surface layer 3*a*. Here, the surface layer 3*a* is a layer containing resin. The electrophotographic roller 1*a* may include an elastic layer 4 between the electroconductive substrate 2*a* and the surface layer 3*a* as illustrated in FIG. 1B. The elastic layer 4 may have a multilayer structure in which a plurality of elastic layers 4 with different compositions is disposed as necessary.

<Electroconductive Substrate>

The electroconductive substrate 2*a* has both the strength enough to support the surface layer 3*a* and an arbitrary one of the elastic layers 4, and the conductivity enough to serve as the electrode. Any material having such strength and conductivity can be used as the electroconductive substrate 2*a*. Examples of those materials include metal such as aluminum, copper, stainless steel, and iron, alloy, and conductive synthetic resin. These materials plated with chromium or nickel may be used. Note that the electroconductive substrate 2*a* may be coated with primer for the purpose of attaching the electroconductive substrate 2*a* and the elastic layer 4 or the surface layer 3*a* formed outside the electroconductive substrate 2*a*. Examples of the primer include primer containing a silane coupling agent.

<Elastic Layer>

Usually, the elastic layer 4 is preferably formed of a molded body of a rubber material. Examples of the rubber material include silicone rubber, urethane rubber, fluorine rubber, natural rubber, butadiene rubber, isoprene rubber, chloroprene rubber, and epichlorohydrin rubber. Any of these rubbers may be used alone or two kinds or more of these rubbers may be mixed and used. Among these, the silicone rubber with small compression set and flexibility is particularly preferable.

The elastic layer 4 contains various additives such as a cross-linking agent, a conductive agent, or filler, as necessary. For the cross-linking agent, a compound that is necessary for a cross-linking reaction is selected as appropriate in accordance with the kind of rubber in the elastic layer 4. As the conductive agent, carbon black, an ionic conductive agent, powder of metal such as aluminum or copper, particles of metal oxide such as conductive tin oxide or conductive titanium oxide, or the like can be used. In particular, carbon black that is inexpensive and easily dispersible is preferably used. Examples of the filler include silica, quartz powder, and calcium carbonate.

The elastic layer 4 is formed by, for example, molding with the use of a liquid material, or extrusion molding with the use of a kneaded rubber material.

<Surface Layer>

The surface layer 3*a* includes resin with at least one of the urethane bond and the amide bond. The resin includes a cationic structure and an anionic structure in the molecule, and includes at least one structure selected from the group consisting of structures expressed by Structural Formula 1 to Structural Formula 4:

$$-(CH_2-CR1=CH-CH_2)- \quad \text{(Structural Formula 1)}$$

(where R1 represents a hydrogen atom or a methyl group)

$$-(R2\text{-}O)- \quad \text{(Structural Formula 2)}$$

(where R2 represents an alkylene group with 5 or more and 14 or less carbons)

(Structural Formula 3)

$$-(R3-O-\overset{\overset{\displaystyle O}{\|}}{C})-$$

(where R3 represents an alkylene group with 5 or more and 14 or less carbons)

(Structural Formula 4)

$$-(R4-O-\overset{\overset{\displaystyle O}{\|}}{C}-O)-$$

(where R4 represents an alkylene group with 6 or more and 14 or less carbons).

In general, when a structure with high polarity such as a cationic structure or an anionic structure is introduced to resin, the resin has a surface with high polarity and therefore, the tackiness tends to be high. However, contrary to expectation, in the surface layer according to the present aspect, an effect that the tackiness was decreased was observed.

In one aspect of the present invention, the resin including at least one of the urethane bond and the amide bond has the cationic structure and the anionic structure in the molecule, and has at least one of structures expressed by Structural Formula 1 to Structural Formula 4. Thus, in regard to the reason why the effect according to one aspect of the present invention is achieved, the present inventors have assumed that it is because the structures with high hydrophilicity are assembled and an ionic bond-hydrogen bond network is formed.

The resin in the surface layer includes the cationic structure and the anionic structure. It is considered that the cationic structure and the anionic structure are bound ionically.

The structures expressed by Structural Formula 1 to Structural Formula 4 in the resin include a hydrophobic structure. Specifically, a carbon chain with 4 to 5 carbons in Structural Formula 1, an alkylene group with 5 or more and 14 or less carbons in Structural Formula 2 and Structural Formula 3, and an alkylene group with 6 or more and 14 or less carbons in Structural Formula 4 are hydrophobic.

Figure 6:
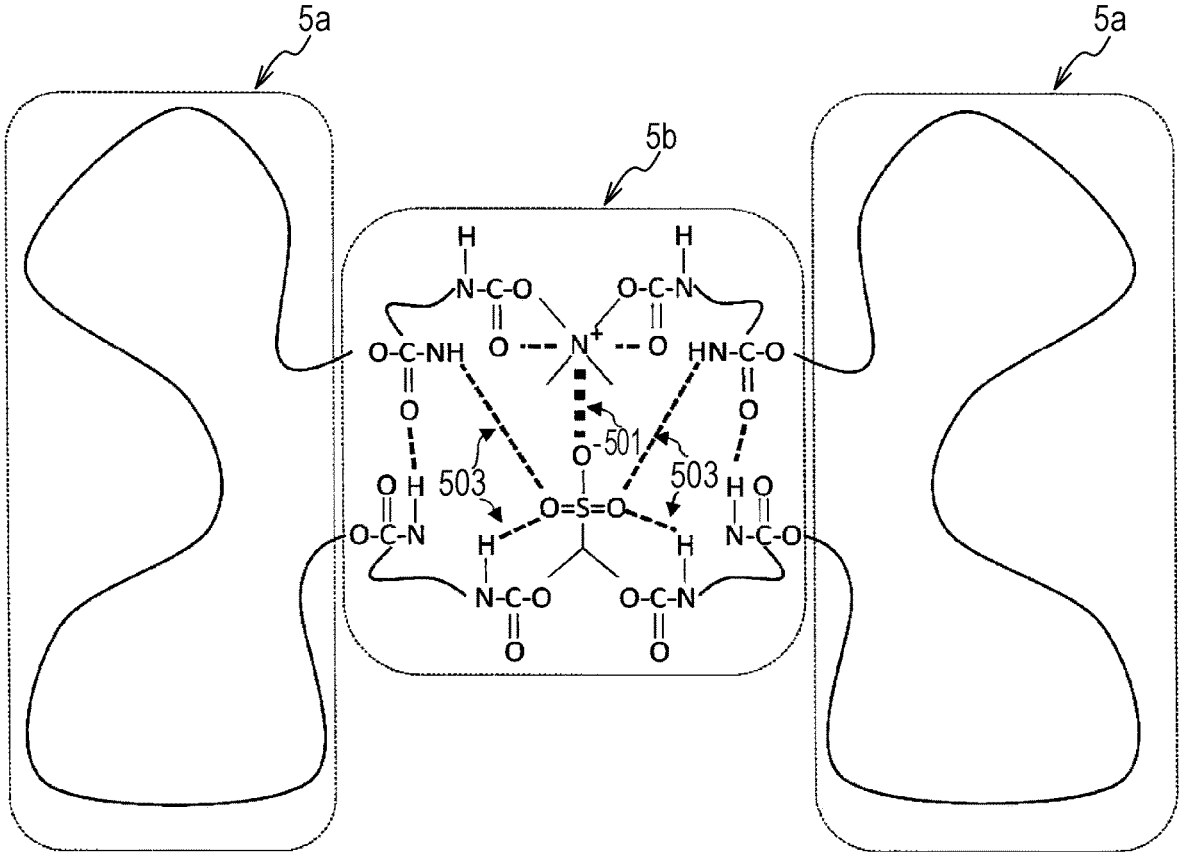
FIG. 6 is an explanatory view of an assumptive mechanism regarding how an effect according to one aspect of the present invention is achieved.

On the other hand, the urethane bond, the amide bond, the cationic structure, and the anionic structure included in the resin are hydrophilic. Therefore, the difference in polarity between these structures serves as a driving force, and a part 5*a* where the groups with hydrophobicity are assembled and a part 5*b* where the groups with hydrophilicity are assembled are formed as illustrated in FIG. 6.

In the part 5*b* where the structures with hydrophilicity are assembled, it is considered that the ionic bond-hydrogen bond network is formed. That is to say, a hydrogen atom bound to a nitrogen atom included in the amide bond and the urethane bond serves as a hydrogen bond donor. Moreover, an oxygen atom that forms a double bond with a carbon bond included in the amide bond and the urethane bond serves as a hydrogen bond acceptor.

In addition, the cationic structure includes a positive charge and therefore serves as a hydrogen bond donor. The anionic structure includes a negative charge and therefore serves as a hydrogen bond acceptor.

In the part 5*b* where the structures with high hydrophilicity are assembled, the hydrogen bond donor and the hydrogen bond acceptor approach each other. As a result, a hydrogen bond network 503 is formed mainly by the anionic structure and the cationic structure with particularly high polarity. The hydrogen bond network 503 is further linked by ionic bond dash lines 501 between the cationic structure and the anionic structure and an ionic bond-hydrogen bond network is formed. Since these networks link between molecular chains in the resin, the degree of freedom of the molecular chain is restricted and the intermolecular interaction due to the entanglement of the molecular chains is reduced. As a result, it is considered that the effect of reducing the tackiness on the surface of the surface layer can be obtained without developing the cross-linking structure that causes an increase in hardness.

That is to say, in order to obtain the effect of the present invention that the flexibility, the wear resistance, and the low tackiness are all achieved, it is preferable that the following elements 1 and 2 are satisfied:

Element 1: to have a main-chain structure with hydrophobicity enough to serve as a driving force for assembling hydrophilic structures (urethane bond, amide bond, cationic structure, and anionic structure); and Element 2: to have an ionic bond to serve as a center of the ionic bond-hydrogen bond network.

Figure 2:
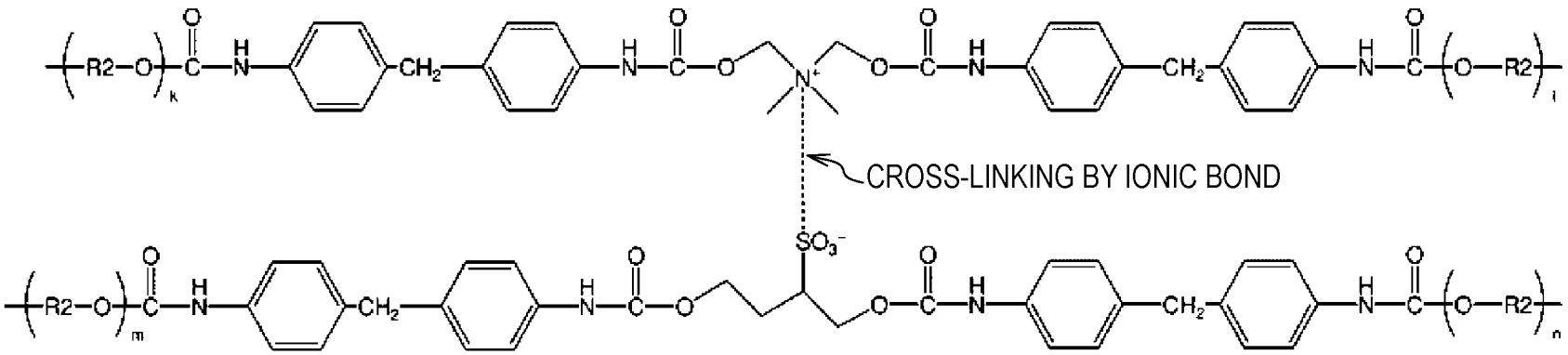
FIG. 2 shows one example of a chemical structure of resin contained in a surface layer according to one aspect of the present invention.

FIG. 2 shows one example of the resin included in the surface layer 3*a* according to the present aspect, that is, the urethane resin having the structure expressed by Structural Formula 2 in a molecule and having an ammonium group as the cationic structure and a sulfonic acid group as the anionic structure. Note that the structure shown in FIG. 2 is merely an example and the present invention is not limited to this structure.

<Urethane Resin>

The urethane resin has a urethane bond in a molecule.

The urethane resin is obtained by a reaction between an isocyanate component and one or a plurality of kinds of polyol components selected from the following group of polyols (i) to (iv):

(i) Polyolefin polyol with a structure expressed by Structural Formula 1;

(ii) Polyether polyol with a structure expressed by Structural Formula 2;

(iii) Polyester polyol with a structure expressed by Structural Formula 3; and (iv) Polycarbonate polyol with a structure expressed by Structural Formula 4.

In Structural Formula 2 or Structural Formula 3, the alkylene group with 5 or more and 14 or less carbons, which is represented by R2 or R3, may have either a straight-chain structure or a branched-chain structure. The alkylene group may be any alkylene group with 5 or more and 14 or less carbons, and specific examples thereof include an n-pentylene group, a 1-methylbutylene group, a 2-methylbutylene group, a 2,2'-dimethylpropylene group, an n-hexylene group, a 1-methylpentylene group, a 2-methylpentylene group, a 3-methylpentylene group, an n-heptylene group, a 1-methylhexylene group, a 2-methylhexylene group, a 3-methylhexylene group, an n-octylene group, a 1-methylheptylene group, a 2-methylheptylene group, a 3-methylheptylene group, a 4-methylheptylene group, an n-nonylene group, an n-decylene group, an n-undecylene group, an n-dodecylene group, an n-tridecylene group, and an n-tetradecylene group. The alkylene group represented by R2 or R3 preferably has 5 or more and 8 or less carbons. When 5 or more carbons are included, the hydrophobicity enough to serve as a driving force for assembling the hydrophilic structures (urethane bond, amide bond, cationic structure, and anionic structure) can be achieved; therefore, the effect of reducing the tackiness can be obtained. When 14 or less carbons are included, the wear resistance necessary for the member can be maintained.

In Structural Formula 4, the alkylene group with 6 or more and 14 or less carbons, which is represented by R4, may have either a straight-chain structure or a branched-chain structure. The alkylene group is not limited to a particular alkylene group, and specific examples thereof include an n-hexylene group, a 1-methylpentylene group, a 2-methylpentylene group, a 3-methylpentylene group, an n-heptylene group, a 1-methylhexylene group, a 2-methylhexylene group, a 3-methylhexylene group, an n-octylene group, a 1-methylheptylene group, a 2-methylheptylene group, a 3-methylheptylene group, a 4-methylheptylene group, an n-nonylene group, an n-decylene group, an n-undecylene group, an n-dodecylene group, an n-tridecylene group, and an n-tetradecylene group. The alkylene group represented by R4 preferably has 6 or more and 8 or less carbons. When 6 or more carbons are included, the hydrophobicity enough to serve as a driving force for assembling the hydrophilic structures (urethane bond, amide bond, cationic structure, and anionic structure) can be achieved; therefore, the effect of reducing the tackiness can be obtained. When 14 or less carbons are included, the wear resistance necessary for the member can be maintained.

As the polyol component, the component having the structure expressed by any of Structural Formula 1 to Structural Formula 4 and the component without the structure expressed by any of Structural Formula 1 to Structural Formula 4 may be used in combination. In this case, it is preferable that the structure expressed by any of Structural Formula 1 to Structural Formula 4 constitutes 10 mass % or more of the entire mass of the urethane resin included in the surface layer. When the structure expressed by any of Structural Formula 1 to Structural Formula 4 constitutes 10 mass % or more, the driving force of assembling the hydrophilic structure (urethane bond, cationic structure, and anionic structure) becomes higher and the effect of reducing the tackiness can therefore be obtained easily.

Specific examples of the polyol component without the structure expressed by Structural Formula 1 to Structural Formula 4 include polyether polyols such as polyethylene glycol, polypropylene glycol, and polytetramethylene glycol, polyester polyols such as polyethylene succinate diol, polybutylene succinate diol, polyethylene adipate diol, and polybutylene adipate diol, and polycarbonate polyols such as polyethylene carbonate diol and polybutylene carbonate diol.

The isocyanate component to react with these polyol components is not limited to a particular component, and examples thereof include: aliphatic polyisocyanates such as ethylene diisocyanate and 1,6-hexamethylene diisocyanate (HDI); alicyclic polyisocyanates such as isophorone diisocyanate (IPDI), cyclohexane 1,3-diisocyanate, and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and a copolymer, an isocyanurate, a TMP adduct, a biuret, or a block of any of the above materials. Among these, aromatic isocyanates such as tolylene diisocyanate, diphenylmethane diisocyanate, and polymeric diphenylmethane diisocyanate are more preferable.

In regard to the mixing ratio of the isocyanate component to react with the polyol component, the ratio of the isocyanate group to 1.0 of hydroxyl group is preferably in the range of 1.1 to 1.8. In this range, it is possible to reduce the remaining of unreacted components.

The amount of urethane bonds is preferably 0.4 mmol or more and 2.0 mmol or less for 1 g of urethane resin. When the urethane bond is contained by 0.4 mmol or more, the ionic bond-hydrogen bond network is formed stably and the effect of reducing the tackiness can be obtained easily. When the urethane bond is contained by 2.0 mmol or less, the flexibility of the surface layer can be maintained easily.

<Amide Resin>

The resin with the amide bond (amide resin) may be, for example, a copolymer that is formed by copolymerizing polyamide and one or a plurality of kinds of compounds selected from the following group of compounds (i) to (iv):

(i) Polyolefin with a structure expressed by Structural Formula 1;

(ii) Polyether with a structure expressed by Structural Formula 2;

(iii) Polyester with a structure expressed by Structural Formula 3; and (iv) Polycarbonate with a structure expressed by Structural Formula 4.

When the polyamide copolymer is synthesized, the component without any of the structures expressed by Structural Formula 1 to Structural Formula 4 may be copolymerized. In this case, it is preferable that the structure expressed by any of Structural Formula 1 to Structural Formula 4 constitutes 10 mass % or more of the entire mass of the amide resin included in the surface layer. When the structure expressed by any of Structural Formula 1 to Structural Formula 4 constitutes 10 mass % or more, the driving force for assembling the hydrophilic structures (amide bond, cationic structure, and anionic structure) becomes higher and the effect of reducing the tackiness can therefore be obtained easily.

Examples of the component without any of the structures expressed by Structural Formula 1 to Structural Formula 4 include the polyol component without any of the structures expressed by Structural Formula 1 to Structural Formula 4, and the polyethylene, polystyrene, and polyarylate components without any of the structures expressed by Structural Formula 1 to Structural Formula 4.

The polyamide component may be Nylon 6, Nylon 66, Nylon 11, Nylon 12, or the like.

The amide bond is preferably contained by 1.0 mmol or more and 3.0 mmol or less for 1 g of amide resin. When the amide bond is contained by 1.0 mmol or more, an ionic bond-hydrogen bond network is formed stably and the effect of reducing the tackiness is obtained easily. When the amide bond is contained by 3.0 mmol or less, the flexibility of the surface layer can be maintained easily.

<Cationic Structure>

The cationic structure refers to a structure that is held in resin including at least one of a urethane bond and an amide bond, preferably held by a covalent bond in a main chain of the resin in the surface layer, and has a cationic group contained in a resin structure. Therefore, a cation that is included in the resin structure but does not constitute a covalent bond with the resin in the surface layer is not included in the cationic structure.

Specific examples thereof include structures including an ammonium group, a sulfonium group, a phosphonium group, a piperidinium group, a pyrrolidinium group, a morpholinium group, an oxazolium group, and a nitrogen-containing aromatic ring group. Examples of the nitrogen-containing aromatic ring group include a pyridinium group, a pyrimidinium group, a pyrazinium group, a pyridazinium group, an imidazolium group, a pyrazolium group, a triazolium group, and a hydride and a derivative thereof.

Above all, the cationic structure with the nitrogen-containing aromatic ring group is particularly preferable. Since such a cationic structure has a conjugated system, the positive charges are not localized and the structure becomes stable, and accordingly a more stable ionic bond-hydrogen bond network can be formed.

<Anionic Structure>

The anionic structure refers to a structure that is held in resin including at least one of a urethane bond and an amide bond, preferably held by a covalent bond in a main chain of the resin in the surface layer, and has an anionic group contained in a resin structure. Therefore, an anion that is included in the resin structure but does not constitute a covalent bond with the resin in the surface layer is not included in the anionic structure. Specific examples thereof include structures including a carboxylic acid group, a sulfonic acid group, a sulfenic acid group, a sulfinic acid group, a phosphate group, a phosphonic acid group, a phosphinic acid group, a perchloric acid group, and an alkoxide anionic group. Above all, the carboxylic acid group and the sulfonic acid group are preferable because these are chemically stable and are easily held by the covalent bond in the main chain of the resin.

When the cationic structure and the anionic structure according to the present invention are bound to the resin including at least one of the urethane bond and the amide bond through the covalent bond, the effect of linking the molecular chain of the resin by the formation of the ionic bond-hydrogen bond network can be obtained.

In one method of covalently bonding the cationic structure and the anionic structure to the urethane resin, a reactive functional group that can react with an isocyanate group is introduced in advance to a compound including the cationic structure or the anionic structure. Examples of the reactive functional group to be introduced include a hydroxyl group and a glycidyl group. By causing the salt with the reactive functional group to react with a polyol compound and an isocyanate compound included in the urethane resin according to the present invention, the urethane resin in which the cationic structure and the anionic structure are covalently bound to the resin structure can be obtained.

One example of a method of covalently bonding the cationic structure and the anionic structure to the amide resin is described below.

A reactive functional group that can react with a carboxyl group is introduced in advance to a compound including the cationic structure and the anionic structure. Examples of the reactive functional group that can react with the carboxyl group to be introduced include a hydroxyl group, a glycidyl group, and a carbodiimide group. By causing the compound with the reactive functional group to react with excessive carboxylic acid compounds, the carboxyl group terminal polyester including the cationic structure and the anionic structure is synthesized. By the reaction between the carboxy-terminal polyester and the diamine compound, the amide resin in which the cationic structure and the anionic structure are covalently bound to the resin structure can be obtained.

Another method of covalently bonding the cationic structure and the anionic structure to the amide resin is described below.

Excessive dicarboxylic acid compounds are caused to react with the diamine compound so as to synthesize a carboxy-terminal polyamide compound. On the other hand, a reactive functional group that can react with a carboxyl group is introduced in advance to a compound including the cationic structure and the anionic structure. Examples of the reactive functional group that can react with the carboxyl group to be introduced include a hydroxyl group, a glycidyl group, and a carbodiimide group. By causing these compounds to react with the previously synthesized carboxy-terminal polyamide compound, the amide resin in which the cationic structure and the anionic structure are covalently bound to the resin structure can be obtained.

In addition, it is preferable that the cationic structure or the anionic structure forms a plurality of covalent bonds between the cationic structure or the anionic structure and the resin. Specifically, a plurality of reactive functional groups is provided to the cationic structure or the anionic structure. By causing these reactive functional groups to react with the resin, a plurality of chemical bonds can be formed between the cationic structure or the anionic structure and the resin. By forming the plurality of chemical bonds, the effect of linking the molecular chain of the resin is increased; thus, the effect of reducing the tackiness can be expected further. The cationic structure including the reactive functional groups is not limited to a particular structure. Examples thereof include a structure with two hydroxyl groups, such as a bis(hydroxyalkyl)ammonium group, a bis(hydroxyalkyl)pyridinium group, and a bis(hydroxyalkyl)imidazolium group, and a structure with three hydroxyl groups, such as a tris(hydroxyalkyl)ammonium group, a tris(hydroxyalkyl)pyridinium group, and a tris(hydroxyalkyl)imidazolium group. The anionic structure including the reactive functional groups is not limited to a particular structure. Examples thereof include a structure with two hydroxyl groups, such as dihydroxyalkane sulfonic acid, dihydroxycarboxylic acid, and dihydroxyalkylester phosphate, and a structure with three hydroxyl groups, such as trihydroxyalkane sulfonic acid, trihydroxycarboxylic acid, and trihydroxyalkylester phosphate.

The total content of the cationic structure and the anionic structure in the surface layer is preferably 0.01 mmol or more for 1 g of the resin including at least one of the urethane bond and the amide bond in the surface layer. This is because the effect of reducing the tackiness can be obtained stably. In addition, the ratio of the number of moles of the cations and anions to the total number of moles of the cationic structure, the anionic structure, the cations, and the anions is preferably 30 mol % or less from the similar perspective. In particular, this ratio is preferably 10 mol % or less. Note that the cationic structure and the anionic structure are the structures that are covalently bound to the resin including at least one of the urethane bond and the amide bond, and the cation and the anion are not covalently bound to the resin including at least one of the urethane bond and the amide bond.

The cationic structure and the anionic structure do not contribute to the conductivity of the surface layer 3*a* because of being covalently bound to the urethane resin or the amide resin. On the other hand, the cation and the anion that are not covalently bound to the urethane resin or the amide resin contribute to the conductivity of the surface layer 3*a*. However, increasing the ratio of the cations and the anions in order to adjust the resistance of the surface layer 3*a*, particularly decrease the resistance, is not preferable from the viewpoint of the effect of reducing the tackiness. Therefore, in order to adjust the resistance of the surface layer 3*a*, it is necessary to add a conductive agent in accordance with the necessity. Examples of the conductive agent include carbon black, an ion conductive agent that is not covalently bound to resin, powder of metal such as aluminum or copper, and particles of metal oxide such as conductive tin oxide or conductive titanium oxide; in particular, carbon black that is inexpensive and easily dispersible is preferably used.

In addition, various kinds of additives such as filler or microparticles for controlling the roughness may be added to the surface layer 3*a* as necessary. Examples of the filler include silica, quartz powder, and calcium carbonate. Examples of the microparticles for controlling the roughness include microparticles of polyurethane resin, polyester resin, polyether resin, polyamide resin, acrylic resin, and phenolic resin. How to form the resin surface layer 3*a* is not limited to a particular method, and spray coating, dip coating, and roll coating are given as examples.

(Developing Blade and Cleaning Blade)

Figure 3:
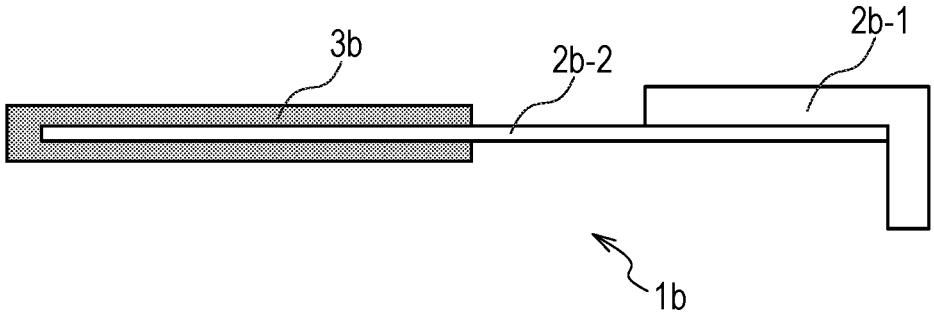
FIG. 3 is a schematic cross-sectional view of one example of an electrophotographic member according to one aspect of the present invention.

One embodiment in which the electrophotographic member according to the present invention is used for a developing blade or a cleaning blade (hereinafter referred to as electrophotographic blade) is illustrated in FIG. 3. In this example, an electroconductive substrate of an electrophotographic blade 1*b* includes a support member 2*b*-1 and a flexible member 2*b*-2. The support member 2*b*-1 supports the electrophotographic blade 1*b* in contact with a contact member (developing roller in the case of using as the developing blade, electrophotographic photosensitive member in the case of using as the cleaning blade), and has rigidity enough to fix the electrophotographic blade 1*b* to the apparatus. In addition, the flexible member 2*b*-2 has the elasticity necessary to bring the electrophotographic blade 1*b* in contact with the contact member with the proper pressure. The material of the support member 2*b*-1 and the flexible member 2*b*-2 may be any material with the necessary conductivity, rigidity, and elasticity and may be similar to the material of the electroconductive substrate 2*a* that is used in the electrophotographic roller described above. The surface layer 3*b* is a layer formed of resin according to the present invention, and the resin similar to the resin of the resin surface layer 3*a* that is used in the electrophotographic roller 1*a* described above can be used. How to form the surface layer 3*b* is not limited to a particular method, and extrusion molding, injection molding, spray coating, dip coating, and roll coating are given as examples.

The electrophotographic member according to the present invention described above can be used suitably for a charging member, a developing member, a toner-supplying member, and a cleaning member in a process cartridge that is detachably attachable to the electrophotographic apparatus, particularly an electrophotographic apparatus main body. In particular, the electrophotographic member according to the present invention can be suitably used as a developing roller, a toner-supplying roller, a developing blade, a charging roller, and a cleaning blade.

(Process Cartridge)

Next, a process cartridge including the electrophotographic member according to the present invention is described. The process cartridge according to the present invention includes at least one member selected from the charging member, the developing member, the toner-supplying member, and the cleaning member, and at least one of these members is the electrophotographic member according to the present invention.

Figure 4:
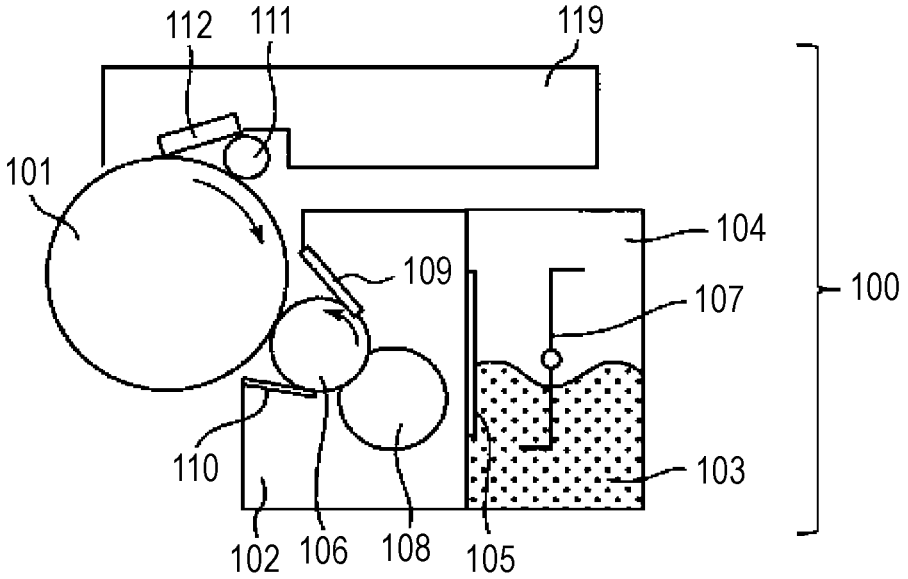
FIG. 4 is a schematic structure view of one example of a process cartridge according to one aspect of the present invention.

FIG. 4 is a schematic cross-sectional view of one example of a process cartridge according to one aspect of the present invention.

A process cartridge 100 illustrated in FIG. 4 is detachably attachable to a main body of an electrophotographic apparatus. The process cartridge 100 includes a development chamber 102 including an opening in a part that faces an electrophotographic photosensitive member 101. At a rear surface of this development chamber 102, a toner container 104 to contain toner 103 is disposed. In the toner container 104, a conveying member 107 that conveys the toner 103 to the development chamber 102 is disposed as necessary. The opening that connects between the development chamber 102 and the toner container 104 is sectioned by a sealing member 105. This sealing member 105 is removed when use of the process cartridge 100 is started. In the development chamber 102, a developing roller 106, a toner-supplying roller 108, a developing blade 109, and a toner blowout preventing sheet 110 are provided.

The toner 103 is applied on the developing roller 106 by the toner-supplying roller 108. The developing roller 106 is rotated in a direction indicated by an arrow in the drawing, and the toner 103 carried on this developing roller 106 is restricted by the developing blade 109 so that the toner 103 has a predetermined layer thickness. Then, the toner 103 is sent to a development area that faces the electrophotographic photosensitive member 101.

The process cartridge 100 includes a charging roller 111, a cleaning blade 112, and a waste toner container 119 in addition to the above structure.

In the process cartridge 100, at least one of the developing roller 106, the toner-supplying roller 108, the developing blade 109, the charging roller 111, and the cleaning blade 112 is the electrophotographic member according to the present invention.

(Electrophotographic Apparatus)

Next, the electrophotographic apparatus including the electrophotographic member according to the present invention is described.

The electrophotographic apparatus according to the present invention includes at least one member selected from the group consisting of the charging member, the developing member, the toner-supplying member, and the cleaning member, and at least one of the members includes the electrophotographic member according to the present invention.

Figure 5:
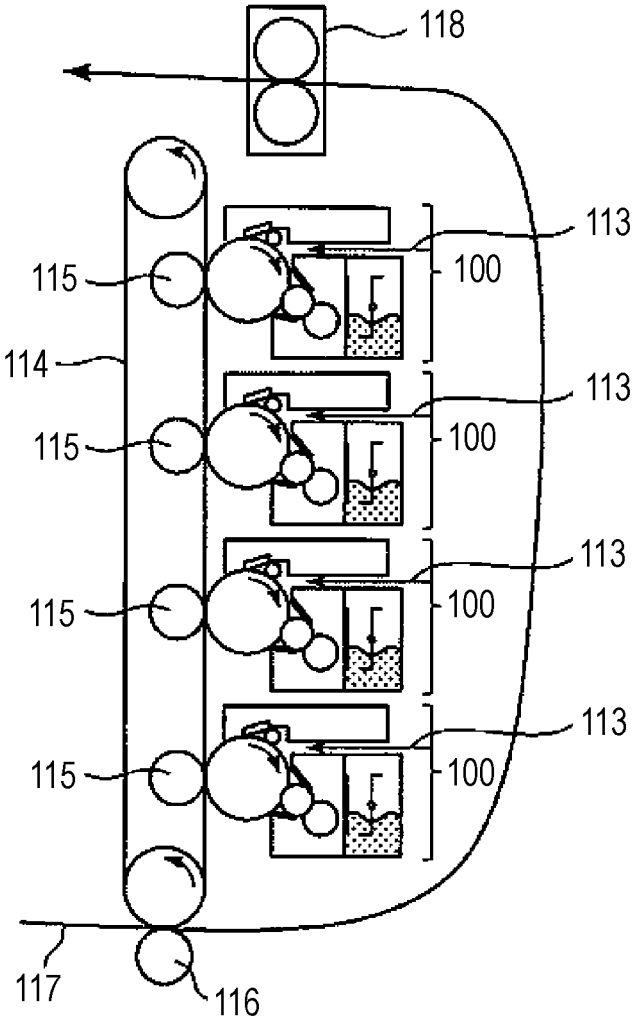
FIG. 5 is a schematic cross-sectional view of one example of an electrophotographic apparatus according to one aspect of the present invention.

FIG. 5 is a schematic cross-sectional view of one example of the electrophotographic apparatus according to one aspect of the present invention. This electrophotographic apparatus is used with the process cartridge 100 illustrated in FIG. 4 mounted.

A printing operation of the electrophotographic apparatus is hereinafter described. The electrophotographic photosensitive member 101 is uniformly charged by the charging roller 111 connected to a bias power source (not shown). Next, with exposure light 113 for writing an electrostatic latent image, the electrostatic latent image is formed on a surface of the electrophotographic photosensitive member 101. The exposure light 113 may be either LED light or laser light.

Next, toner that is charged to have negative polarity by the developing roller 106 incorporated in the process cartridge 100 that is detachably attachable to the electrophotographic apparatus main body is applied (developed) on the electrostatic latent image. Next, a toner image is formed on the electrophotographic photosensitive member 101, and the electrostatic latent image is converted into a visible image. Here, voltage is applied to the developing roller 106 by a bias power source (not shown).

The toner image developed on the electrophotographic photosensitive member 101 is primarily transferred onto an intermediate transfer belt 114. A primary transfer member 115 is in contact with a rear surface of the intermediate transfer belt 114. By applying the voltage to the primary transfer member 115, the toner image with the negative polarity is primarily transferred from the electrophotographic photosensitive member 101 to the intermediate transfer belt 114. The primary transfer member 115 may have either a roller shape or a blade shape.

In the electrophotographic apparatus illustrated in FIG. 5, four process cartridges 100 each incorporating yellow, cyan, magenta, or black toner are detachably attached to the electrophotographic apparatus main body. Then, the aforementioned charging, exposing, developing, and primarily transferring steps are performed sequentially with a predetermined time difference, and on the intermediate transfer belt 114, four toner images for expressing a full-color image are overlapped on each other. The toner image on the intermediate transfer belt 114 is conveyed to a position opposite to a secondary transfer member 116 as the intermediate transfer belt 114 rotates. Here, between the intermediate transfer belt 114 and the secondary transfer member 116, a recording sheet corresponding to a transfer material is conveyed along a conveyance route 117 of the recording sheet at a predetermined timing. Then, by applying a secondary transfer bias on the secondary transfer member 116, the toner image on the intermediate transfer belt 114 is transferred to the recording sheet. The recording sheet on which the toner image has been transferred by the secondary transfer member 116 is conveyed to a fixing device 118 and the toner image on the recording sheet is melted and fixed on the recording sheet. After that, the recording sheet is discharged out of the electrophotographic apparatus; thus, the printing operation ends. Note that the toner image that is not transferred from the electrophotographic photosensitive member 101 to the intermediate transfer belt 114 and remains on the electrophotographic photosensitive member 101 is scraped off by the cleaning blade 112 and housed in the waste toner container 119.

EXAMPLES

Specific examples and comparative examples of the electrophotographic member according to the present invention are described below.

<Polyol Compound>

Synthesis of Polyether Polyol P-1

The present compound was synthesized by a known method (*1) in which ether was synthesized by the dehydration condensation reaction between alcohols in the presence of an acid catalyst.

That is to say, in a reaction container, 438.7 g (3 moles) of 1,8-octane diol (manufactured by Tokyo Chemical Industry Co., Ltd.) and 29.4 g (0.3 moles) of concentrated sulfuric acid were mixed, and the mixture was heated at 130° C. for 12 hours under a nitrogen atmosphere. The resulting reaction solution was cooled down to room temperature and then poured little by little into 300 g of 4-mass % sodium hydroxide aqueous solution that was cooled in ice. Then, the solution was stirred so as to be sufficiently neutralized. After the solution was left at rest, a white wax-like solid that was precipitated was extracted, and the solid was washed with 200 g of water three times. After that, the remaining water and unreacted components were removed under reduced pressure; thus, polyether polyol P-1 expressed by Structural Formula 5 was obtained. The number-average molecular weight of the obtained polyol was 2500.

*1: See "Organic Chemistry vol. 1, sixth edition" pp. 310-311 (issued in 1994, Tokyo Kagaku Dojin), authored by Morrison Boyd, translated by Yasuhiro Nakadaira, Masayasu Kurono, and Koji Nakanishi, etc.

$$HO\text{-}(CH_2\text{-}CH_2\text{-}CH_2\text{-}CH_2\text{-}CH_2\text{-}CH_2\text{-}CH_2CH_2\text{-}O)_n\text{-}H$$

(Structural Formula 5)

Synthesis of Polyether Polyol P-2

The present compound was synthesized in accordance with an established method of synthesizing polyether polyol (for example, a method disclosed in Japanese Patent Application Laid-Open No. S63-235320). That is to say, in a reaction container, 430.6 g (5 moles) of well-dried 3-methyl tetrahydrofuran was held at 15° C. Into this solution, 16.4 g of 70% perchloric acid and 120 g of acetic anhydride were added, and the mixture was subjected to reaction for five hours. Next, the obtained reaction mixture was poured into 600 g of 20% sodium hydroxide aqueous solution, and the mixture was refined. In addition, the remaining water and solvent component were removed under reduced pressure, and thus polyether polyol P-2 expressed by Structural Formula 6 was obtained. The number-average molecular weight of the obtained polyol was 2000.

(Structural Formula 6)

$$HO\text{-}(CH_2\text{-}CH_2\text{-}CH(CH_3)\text{-}CH_2\text{-}O)_n\text{-}H$$

Synthesis of Polyether Polyol P-3

Polyether polyol P-3 expressed by Structural Formula 7 was obtained in a manner similar to the synthesis of P-1 except that 438.7 g (3 moles) of 1,8-octane diol was changed to 691.2 g (3 moles) of 1,14-tetradecane diol (manufactured by Wako Pure Chemical Corporation). The number-average molecular weight of the obtained polyol was 2500.

$$HO\text{-}(CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}CH_2\text{-}O)_n\text{-}H$$

(Structural Formula 7)

Synthesis of Polyether Polyol P-4

Polyether polyol P-4 expressed by Structural Formula 8 was obtained in a manner similar to the synthesis of P-1 except that 438.7 g (3 moles) of 1,8-octane diol was changed to 354.5 g (3 moles) of 2,5-hexane diol (manufactured by Tokyo Chemical Industry Co., Ltd.). The number-average molecular weight of the obtained polyol was 2500.

(Structural Formula 8)

$$HO\text{-}(CH(CH_3)\text{-}CH_2\text{-}CH_2\text{-}CH(CH_3)\text{-}O)_n\text{-}H$$

Synthesis of Polyether Polyol P-5

Polyether polyol P-5 expressed by Structural Formula 9 was obtained in a manner similar to the synthesis of P-1 except that 438.7 g (3 moles) of 1,8-octane diol was changed to 438.7 g (3 moles) of 2,5-dimethyl-2,5-hexane diol (manufactured by Tokyo Chemical Industry Co., Ltd.). The number-average molecular weight of the obtained polyol was 2500.

(Structural Formula 9)

$$HO\text{-}(C(CH_3)_2\text{-}CH_2\text{-}CH_2\text{-}C(CH_3)_2\text{-}O)_n\text{-}H$$

Synthesis of Polyether Polyol P-6

Polyether polyol P-6 expressed by Structural Formula 10 was obtained in a manner similar to the synthesis of P-1 except that 438.7 g (3 moles) of 1,8-octane diol was changed to 480.8 g (3 moles) of 2-butyl-2-ethyl-1,3-propane diol (manufactured by Tokyo Chemical Industry Co., Ltd.). The number-average molecular weight of the obtained polyol was 2500.

(Structural Formula 10)

$$HO\text{-}(CH_2\text{-}C(CH_2\text{-}CH_3)(CH_2\text{-}CH_2\text{-}CH_2\text{-}CH_3)\text{-}CH_2\text{-}O)_n\text{-}H$$

(Polyester Polyol P-7)

As polyester polyol P-7, polyester polyol including 3-methyl 1,5-pentane diol and adipic acid (product name: KURARAY POLYOL P-2010, manufactured by KURARAY CO., LTD.) was used.

(Polycarbonate Polyol P-8)

As polycarbonate polyol P-8, polycarbonate polyol including 3-methyl 1,5-pentane diol and 1,6-hexane diol (product name: KURARAY POLYOL C-1090, manufactured by KURARAY CO., LTD.) was used.

(Polybutadiene Diol P-9)

As polybutadiene diol P-9, hydroxyl group terminal liquid polybutadiene (product name: Poly bd R-45HT, manufactured by Idemitsu Kosan Co., Ltd.) was used.

(Polyisoprene Diol P-10)

As polyisoprene diol P-10, hydroxyl group terminal liquid polyisoprene (product name: Poly ip, manufactured by Idemitsu Kosan Co., Ltd.) was used.

(Polyester Polyol P-11)

As polyester polyol P-11, polyester polyol including 3-methyl 1,5-pentane diol and adipic acid (product name: KURARAY POLYOL P-510, manufactured by KURARAY CO., LTD.) was used.

Polyester Polyol P-12)

As polyester polyol P-12, polyester polyol including 3-methyl 1,5-pentane diol and adipic acid (product name: KURARAY POLYOL P-5010, manufactured by KURARAY CO., LTD.) was used.

(Polyether Polyol P-13)

As polyether polyol P-13, polypropylene glycol, diol type 2,000 (manufactured by Wako Pure Chemical Corporation) was used.

(Polyether Polyol P-14)

As polyether polyol P-14, PTMG 2000 (manufactured by Mitsubishi Chemical Corporation) was used.

TABLE 1

| No. | Name of compound | Composition | Note |
|---|---|---|---|
| P-1 | Polyether polyol | Structural Formula (5) | |
| P-2 | | Structural Formula (6) | |
| P-3 | | Structural Formula (7) | |
| P-4 | | Structural Formula (8) | |
| P-5 | | Structural Formula (9) | |
| P-6 | | Structural Formula (10) | |
| P-7 | KURARAY POLYOL P-2010 | MPD/adipic acid polyester polyol | KURARAY CO., LTD |
| P-8 | KURARAY POLYOL C-1090 | MPD/HD polycarbonate polyol | |
| P-9 | Poly bd R-45HT | Hydroxyl group terminal liquid polybutadiene | Idemitsu Kosan Co., Ltd. |
| P-10 | Poly ip | Hydroxyl group terminal liquid polyisoprene | |
| P-11 | KURARAY POLYOL P-510 | MPD/adipic acid polyester polyol | KURARAY CO., LTD |
| P-12 | KURARAY POLYOL P-5010 | MPD/adipic acid polyester polyol | |
| P-13 | Polyether polyol | Polypropylene glycol | Wako Pure Chemical Corporation |
| P-14 | Polyether polyol | Polytetramethylene glycol | Mitsubishi Chemical Corporation |

<Isocyanate Group Terminal Urethane Prepolymer>

Synthesis of Urethane Prepolymer U-1

Under the nitrogen atmosphere, 300 parts by mass of polyol compound P-1 was dropped gradually to 100 parts by mass of polymeric MDI (product name: Millionate MR-200, manufactured by Tosoh Corporation) in a reaction container, while the temperature in the reaction container was maintained at 65° C. After the dropping, the mixture was subjected to reaction at 65° C. for 1.5 hours, and then 80.0 parts by mass of methylethylketone was added. The resulting reaction mixture was cooled down to room temperature, and thus urethane prepolymer U-1 containing 5.4 mass % of the isocyanate group was obtained.

Synthesis of urethane prepolymers U-2 to U-14

Urethane prepolymers U-2 to U-14 were obtained through a procedure similar to the procedure of synthesizing urethane prepolymer U-1 except that the kind and the mixing amount of polyol compounds were changed as shown in Table 2.

TABLE 2

| | Isocyanate compound | | Polyol compound | |
|---|---|---|---|---|
| No. | Name of compound | Adding amount/ parts by mass | No. | Adding amount/ parts by mass |
| U-1 | Millionate MR-200 | 100 | P-1 | 300 |
| U-2 | | | P-2 | 275 |
| U-3 | | | P-3 | 300 |
| U-4 | | | P-4 | 300 |
| U-5 | | | P-5 | 300 |
| U-6 | | | P-6 | 300 |
| U-7 | | | P-7 | 275 |
| U-8 | | | P-8 | 190 |
| U-9 | | | P-9 | 315 |
| U-10 | | | P-10 | 300 |
| U-11 | | | P-11 | 120 |
| U-12 | | | P-12 | 370 |
| U-13 | | | P-13 | 275 |
| U-14 | | | P-14 | 275 |

<Compound with Cationic Structure>

Ionic compounds with the cationic structure that are represented by CT-1 to CT-4 and CT-6 to CT-8 are synthesized by a known nucleophilic substitution reaction such as the Menschutkin reaction. That is to say, a compound with the cationic structure and the hydroxyl group was synthesized by using a compound with a nucleophilic hetero atom as a nucleophilic agent and using bromoalkyl alcohol as an electrophilic agent. Specific description is made below.

Synthesis of Ionic Compound CT-1

Under the nitrogen atmosphere, 15.0 g (0.22 moles) of imidazole (manufactured by The Nippon Synthetic Chemical Industry Co., Ltd.) and 9.2 g of sodium hydride (60%, dispersion in paraffin liquid, manufactured by Tokyo Chemical Industry Co., Ltd.) were dissolved in 60.0 g of tetrahydrofuran. To this mixture, 60.0 g (0.48 moles) of 2-bromoethanol (manufactured by Tokyo Chemical Industry Co., Ltd.) that was dissolved in 80.0 g of tetrahydrofuran was dropped at room temperature for 30 minutes, and the obtained mixture was thermally refluxed at 85° C. for 12 hours. After that, 100 ml of water was added to the reaction solution, and the solvent was distilled off under the reduced pressure. To the residue, 200 ml of ethanol was added and the mixture was stirred at room temperature. Then, the insoluble matter was removed through celite filtration, and the solvent is distilled off again under the reduced pressure and thus, the ionic compound CT-1 was obtained. The ionic compound CT-1 is the compound expressed by the following Structural Formula 11.

(Structural Formula 11)

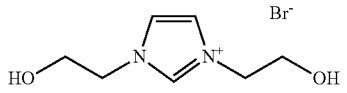

Synthesis of Ionic Compound CT-2

Into 45.0 g of acetonitrile, 15.1 g (0.10 moles) of 4-pyridin-4-yl-butan-1-ol (manufactured by Sigma-Aldrich) was dissolved, and to this mixture, 16.8 g (0.11 moles) of 4-bromo-1-butanol (manufactured by Tokyo Chemical Industry Co., Ltd.) was dropped at room temperature for 30 minutes. The resulting mixture was thermally refluxed at 90° C. for 12 hours. Next, the reaction solution was cooled down to room temperature, and acetonitrile was distilled off under the reduced pressure. The obtained concentrate was washed with 30.0 g of diethyl ether, and the supernatant fluid was removed by separation. The washing and separating operations were repeated three times, and the obtained residue was dried under the reduced pressure; thus, the ionic compound CT-2 was obtained. The ionic compound CT-2 is the compound expressed by the following Structural Formula 12.

(Structural Formula 12)

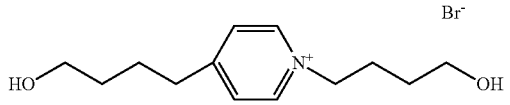

Synthesis of Ionic Compound CT-3

Into 65.0 g of tetrahydrofuran, 15.5 g (0.12 moles) of 2-(2-hydroxyethyl)-1-methylpyrrolidine (manufactured by Tokyo Chemical Industry Co., Ltd.) and 13.5 g of sodium hydride (60%, dispersion in paraffin liquid, manufactured by Tokyo Chemical Industry Co., Ltd.) were dissolved. Next, the reaction system was ice-cooled under the nitrogen atmosphere. Subsequently, 16.2 g (0.13 moles) of 2-bromoethanol (manufactured by Tokyo Chemical Industry Co., Ltd.) dissolved in 40.0 g of tetrahydrofuran was dropped for 30 minutes. The reaction solution was thermally refluxed for 12 hours, and 100 ml of water was added thereto. Then, the solvent was distilled off under the reduced pressure. To the residue, 80 ml of ethanol was added and the mixture was stirred at room temperature. After the insoluble matter was removed by celite filtration, the solvent was distilled off again under the reduced pressure. Thus, the ionic compound CT-3 was obtained. The ionic compound CT-3 is the compound expressed by the following Structural Formula 13.

(Structural Formula 13)

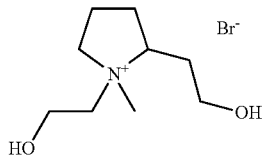

Synthesis of Ionic Compound CT-4

A dimroth was attached to an eggplant flask, and 14.5 g (0.17 moles) of piperidine (manufactured by Tokyo Chemical Industry Co., Ltd.) and 45.0 g (0.36 moles) of 2-bromoethanol (manufactured by Tokyo Chemical Industry Co., Ltd.) were dissolved in 200 ml of acetonitrile, and 69 g of potassium carbonate was added thereto. The mixture was refluxed over night at a boiling point of 90° C., and the reaction solution was separated with ethyl acetate/water. The organic layer was collected and the solvent was distilled off under the reduced pressure. Thus, CT-4 as the white solid was obtained. The ionic compound CT-4 is the compound expressed by the following Structural Formula 14.

(Structural Formula 14)

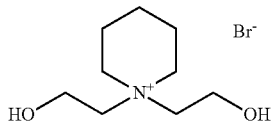

(Ionic Compound CT-5)

Bis(2-hydroxyethyl)dimethylammonium chloride (manufactured by Tokyo Chemical Industry Co., Ltd.) that is expressed by the following Structural Formula 15 was used as the ionic compound CT-5.

(Structural Formula 15)

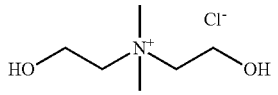

Synthesis of Ionic Compound CT-6

Into 50 ml of acetonitrile, 24.4 g (0.20 moles) of 2,2'-thiodiethanol (manufactured by Tokyo Chemical Industry Co., Ltd.) as the nucleophilic agent was dissolved, and 36.7 g (0.24 moles) of 4-bromo-1-butanol (manufactured by Tokyo Chemical Industry Co., Ltd.) was added thereto at room temperature. Then, the mixture was thermally refluxed at 90° C. for 72 hours. After that, the solvent was distilled off under the reduced pressure. The obtained condensate was washed with diethyl ether, and the supernatant fluid was removed by decantation. The washing and decantation operations were repeated three times, and thus CT-6 was obtained. The ionic compound CT-6 is the compound expressed by the following Structural Formula 16.

(Structural Formula 16)

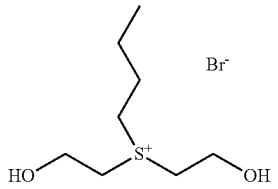

Synthesis of Ionic Compound CT-7

Into 50 ml of acetonitrile, 21.2 g (0.20 moles) of 2-hydroxyethyl-dimethylphosphine (manufactured by Chem Space) was dissolved, and 30.0 g (0.24 moles) of 2-bromoethanol (manufactured by Tokyo Chemical Industry Co., Ltd.) was added thereto at room temperature. Then, the mixture was thermally refluxed at 90° C. for 72 hours. After that, the solvent was distilled off under the reduced pressure. The obtained condensate was washed with diethyl ether, and the supernatant fluid was removed by decantation. The washing and decantation operations were repeated three times, and thus CT-7 was obtained. The ionic compound CT-7 is the compound expressed by the following Structural Formula 17.

(Structural Formula 17)

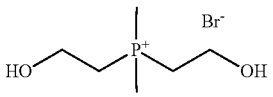

Synthesis of Ionic Compound CT-8

Into 80.0 g of tetrahydrofuran, 15.1 g (0.12 moles) of 2-(2-methyl-1H-imidazol-1-yl)ethanol (manufactured by Sigma-Aldrich) and 9.2 g of sodium hydride (60%, dispersion in paraffin liquid, manufactured by Tokyo Chemical Industry Co., Ltd.) were dissolved. To this mixture, 14.2 g (0.13 moles) of ethyl bromide (manufactured by Showa Chemical) that was dissolved in 80.0 g of tetrahydrofuran was dropped at room temperature for 30 minutes, and the obtained mixture was thermally refluxed at 85° C. for 12 hours. Next, 100 ml of water was added to the reaction solution, and the solvent was distilled off under the reduced pressure. To the residue, 200 ml of ethanol was added and the mixture was stirred at room temperature. Then, after the insoluble matter was removed by celite filtration, the solvent was distilled off again under the reduced pressure. Thus, the ionic compound CT-8 was obtained. The ionic compound CT-8 is the compound expressed by the following Structural Formula 18.

(Structural Formula 18)

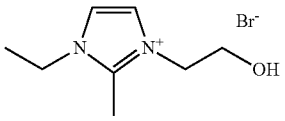

TABLE 3

| No. | Cationic functional group | Anion | Reactive functional group |
|---|---|---|---|
| CT-1 | Imidazolium group | Bromide ion | Hydroxyl group bifunctional |
| CT-2 | Pyridinium group | | |
| CT-3 | Pyrrolidinium group | | |
| CT-4 | Piperidinium group | | |
| CT-5 | Ammonium group | Chloride ion | |
| CT-6 | Sulfonium group | Bromide ion | |
| CT-7 | Phosphonium group | | |
| CT-8 | Imidazolium group | | Hydroxyl group monofunctional |

<Compound with Anionic Structure>

Synthesis of Ionic Compound Raw Material AN-1

As an ionic compound raw material AN-1, 2-sulfo-1,4-butanediol (manufactured by APAC Pharmaceutical) that is expressed by the following Structural Formula 19 was used.

(Structural Formula 19)

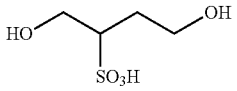

Synthesis of Ionic Compound Raw Material AN-2

As an ionic compound raw material AN-2, butanoic acid, 4-hydroxy-2-(2-hydroxyethyl)(manufactured by Aurora Fine Chemicals) that is expressed by the following Structural Formula 20 was used.

(Structural Formula 20)

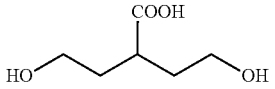

Synthesis of Ionic Compound Raw Material AN-3

An ionic compound raw material AN-3 was synthesized by copolymerizing phosphate modified acrylate, hydroxyl group containing acrylate, and alkyl modified acrylate. That is to say, into a reaction container equipped with a stirring device, a thermometer, a reflux tube, a dropping device, and a nitrogen gas introduction tube, 300.0 parts by mass of dry methylethylketone was set, and the temperature was increased to 87° C. under the nitrogen gas air flow. The mixture was thermally refluxed. Next, a mixture including 29.4 parts by mass (0.14 moles) of light ester P-1M (manufactured by KYOEISHA CHEMICAL Co., LTD.), 15.6 parts by mass (0.12 moles) of 2-hydroxyethyl methacrylate (manufactured by Tokyo Chemical Industry Co., Ltd.), 65.4 parts by mass (0.46 moles) of n-butylmethacrylate (manufactured by Tokyo Chemical Industry Co., Ltd.), and 0.2 parts by mass of initiator (product name: Kayaester O, manufactured by Kayaku Akzo Corporation) was gradually dropped for one hour, and the mixture was thermally refluxed for three hours while the temperature was maintained at 87° C. Next, after the temperature was decreased to 50° C., 200.0 parts by mass of methylethylketone was distilled off under the reduced pressure. After the mixture was cooled to room temperature, the resin AN-3 expressed by the following Structural Formula 21 was obtained. In Structural Formula 21, 1=1, m=1, and n=4.

(Structural Formula 21)

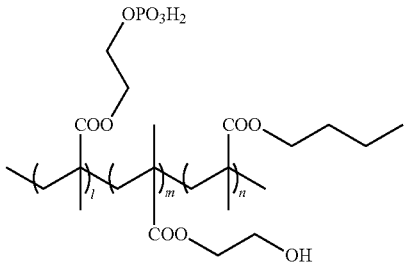

(Ionic Compound Raw Material AN-4)

As an ionic compound raw material AN-4, 3-hydroxypropane sulfonic acid (manufactured by Tokyo Chemical Industry Co., Ltd.) that is expressed by the following Structural Formula 22 was used.

(Structural Formula 22)

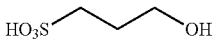

TABLE 4

| No. | Cation | Anionic functional group | Reactive functional group | Note |
|---|---|---|---|---|
| AN-1 | Proton | Sulfonic acid group | Hydroxyl group bifunctional | APAC Pharmaceutical |
| AN-2 | Proton | Carboxylic acid group | Hydroxyl group bifunctional | Aurora Fine Chemicals |
| AN-3 | Proton | Phosphate group | Hydroxyl group multifunctional | |
| AN-4 | Proton | Sulfonic acid group | Hydroxyl group monofunctional | Tokyo Chemical Industry Co., Ltd. |

<Ionic Compounds IP-1 to IP-12>

Ionic compounds IP-1 to IP-12 were synthesized by the known ion-exchange reaction. That is to say, the ionic compound with a desired cationic structure (any of CT1 to CT8) and the ionic compound with a desired anionic structure (any of AN-1 to AN-4) are dissolved in an equimolar amount in an organic solvent. After that, the halogenated hydrogen compound that is unnecessary is washed away with ion-exchange water.

Synthesis of Ionic Compound IP-1

Into 10.0 g of acetonitrile, 11.9 g (0.05 moles) of the ionic compound raw material CT-1 and 4.5 g (0.05 moles) of the ionic compound raw material AN-1 (2-sulfo-1,4-butanediol (manufactured by APAC Pharmaceutical)) were dissolved. After that, the mixture was stirred at 60° C. for 12 hours. To the obtained solution, 20 g of ethyl acetate was added and the mixture was washed three times using 8.0 g of ion-exchange water. Subsequently, ethyl acetate was distilled off under the reduced pressure and the ionic compound IP-1 was obtained. The ionic compound IP-1 is the compound expressed by the following Structural Formula 23.

(Structural Formula 23)

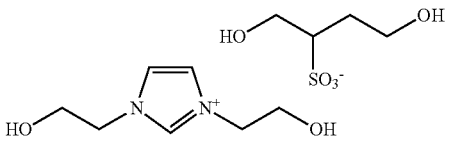

Synthesis of Ionic Compounds IP-2 and IP-3

The ionic compounds IP-2 and IP-3 were obtained in a manner similar to IP-1 except that the ionic compound raw material AN-1 was changed to AN-2 or AN-3 and the mixing amount was changed as shown in Table 5. The ionic compounds IP-2 and IP-3 are the compounds expressed by the following Structural Formulae 24 and 25, respectively. In Structural Formula 25, 1=1, m=1, and n=4.

(Structural Formula 24)

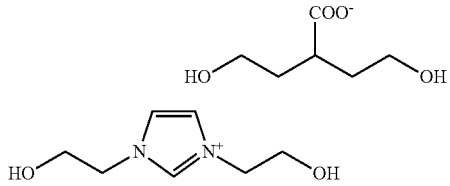

(Structural Formula 25)

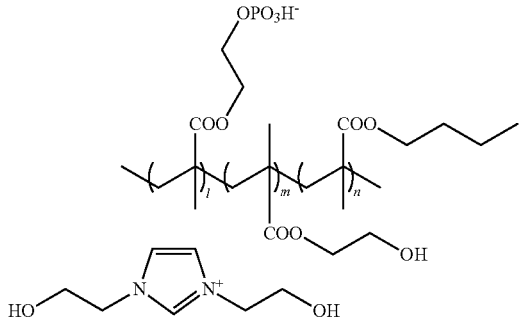

Synthesis of Ionic Compound IP-4

Into 10.0 g of acetonitrile, 15.2 g (0.05 moles) of the ionic compound raw material CT-2 and 4.5 g (0.05 moles) of the ionic compound raw material AN-1 (2-sulfo-1,4-butanediol (manufactured by APAC Pharmaceutical)) were dissolved, and the mixture was stirred at 60° C. for 12 hours. After 20 g of ethyl acetate was added to the obtained solution, the mixture was washed three times using 8.0 g of ion exchange water. Subsequently, ethyl acetate was distilled off under the reduced pressure, and the ionic compound IP-4 was obtained. The ionic compound IP-4 is the compound expressed by the following Structural Formula 26.

(Structural Formula 26)

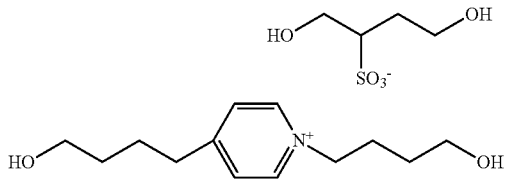

Synthesis of Ionic Compounds IP-5 and IP-6

The ionic compounds IP-5 and IP-6 were obtained in a manner similar to IP-4 except that the ionic compound raw material AN-1 was changed to AN-2 or AN-3 and the mixing amount was changed as shown in Table 5. The ionic compounds IP-5 and IP-6 are the compounds expressed by the following Structural Formulae 27 and 28, respectively. In Structural Formula 28, 1=1, m=1, and n=4.

(Structural Formula 27)

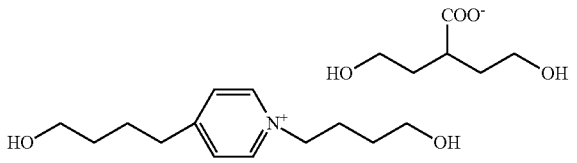

(Structural Formula 28)

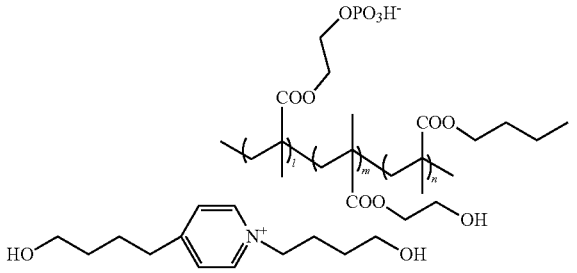

Synthesis of Ionic Compounds IP-7 to IP-11

The ionic compounds IP-7 to IP-11 were obtained in a manner similar to IP-1 except that the ionic compound raw material CT-1 was changed to CT-3 to CT-7 and the mixing amount was changed as shown in Table 5. The ionic compounds IP-7 to IP-11 are the compounds expressed by the following Structural Formulae 29 to 33, respectively.

(Structural Formula 29)

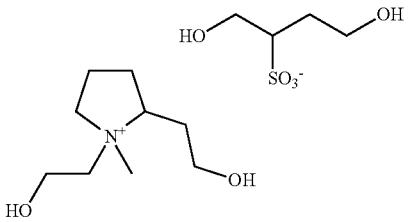

(Structural Formula 30)

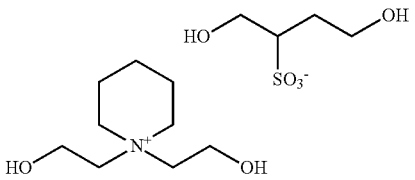

-continued (Structural Formula 31)

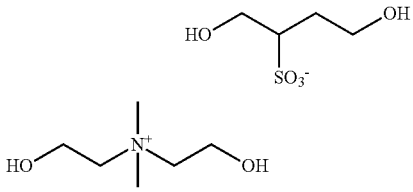

(Structural Formula 32)

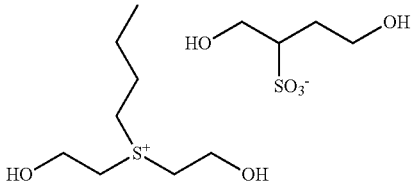

(Structural Formula 33)

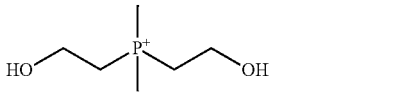

Synthesis of Ionic Compound IP-12

The ionic compound IP-12 was obtained in a manner similar to IP-1 except that the ionic compound raw material CT-1 was changed to CT-8, the ionic compound raw material AN-1 was changed to AN-4, and the mixing amount was changed as shown in Table 5. The ionic compound IP-12 is the compound expressed by the following Structural Formula 34.

(Structural Formula 34)

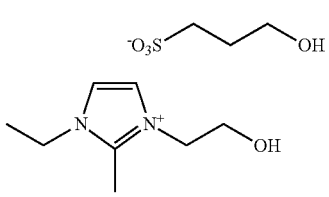

(Ionic Compound IP-13)

As an ionic compound IP-13, sodium methane sulfonate (manufactured by Tokyo Chemical Industry Co., Ltd.) that is expressed by the following Structural Formula 35 was used.

$H_3C—SO_3^-Na^+$ (Structural Formula 35)

TABLE 5

| | Compound with cationic functional group | | Compound with anionic functional group | | Cationic | Anionic | | |
|---|---|---|---|---|---|---|---|---|
| | | Adding | | Adding | functional | functional | Reactive functional group | |
| No. | No. | amount/g | No. | amount/g | group | group | Cation side | Anion side |
| IP-1 | CT-1 | 11.9 | AN-1 | 4.5 | Imidazolium group | Sulfonic acid group | Hydroxyl group bifunctional | Hydroxyl group bifunctional |
| IP-2 | CT-1 | 11.9 | AN-2 | 7.4 | | Carboxylic acid group | | |
| IP-3 | CT-1 | 11.9 | AN-3 | 29.2 | | Phosphate group | | |

TABLE 5-continued

| | Compound with cationic functional group | | Compound with anionic functional group | | Cationic | Anionic | | |
|---|---|---|---|---|---|---|---|---|
| | | Adding | | Adding | functional | functional | Reactive functional group | |
| No. | No. | amount/g | No. | amount/g | group | group | Cation side | Anion side |
| IP-4 | CT-2 | 15.2 | AN-1 | 4.5 | Pyridinium group | Sulfonic acid group | | |
| IP-5 | CT-2 | 15.2 | AN-2 | 7.4 | | Carboxylic acid group | | |
| IP-6 | CT-2 | 15.2 | AN-3 | 29.2 | | Phosphate group | | |
| IP-7 | CT-3 | 12.7 | AN-1 | 4.5 | Pyrrolidinium group | Sulfonic acid group | | |
| IP-8 | CT-4 | 12.7 | AN-1 | 4.5 | Piperidinium group | | | |
| IP-9 | CT-5 | 8.5 | AN-1 | 4.5 | Ammonium group | | | |
| IP-10 | CT-6 | 12.9 | AN-1 | 4.5 | Sulfonium group | | | |
| IP-11 | CT-7 | 11.6 | AN-1 | 4.5 | Phosphonium group | | | |
| IP-12 | CT-8 | 11.8 | AN-4 | 7.0 | Imidazolium group | Sulfonic acid group | Hydroxyl group monofunctional | Hydroxyl group monofunctional |
| IP-13 | | Sodium methane sulfonate | | | Sodium ion | Sulfonic acid group | None | None |

Example 1

Preparation of Electroconductive Substrate 2*a*

As the electroconductive substrate 2*a*, a core metal with a diameter of 6 mm made of stainless steel (SUS304) that was coated with primer (product name: DY39-012, manufactured by Dow Corning Toray Co., Ltd.) and then printed was prepared.

(Manufacture of Elastic Roller)

The substrate 2*a* that was prepared as above was disposed in a mold, and an addition type silicone rubber composition containing the following materials was poured into a cavity in the mold:

Liquid silicone rubber material (product name: SE6905A/B, manufactured by Dow Corning Toray Co., Ltd.), 100.0 parts by mass; and Carbon black (product name: DENKA BLACK powder, manufactured by Denka Company Limited.), 5.0 parts by mass.

Subsequently, the mold was heated and the silicone rubber was vulcanized at 130° C. for 5 minutes, so that the rubber was cured. The substrate 2*a* around which the cured silicone rubber layer was formed was released from the mold, and then the core metal was further heated at 180° C. for an hour. Thus, the curing reaction of the silicone rubber layer was completed. In this manner, an elastic roller D-1 in which the silicone rubber elastic layer 4 with a diameter of 12 mm was formed around the substrate 2 was manufactured.

Preparation of Coating for Forming Surface Layer

The following materials were mixed: 49.1 parts by mass of polyurethane prepolymer U-1, 50.9 parts by mass of polyol compound P-1, 0.25 parts by mass of ionic compound IP-1, 15.0 parts by mass of carbon black (product name: TOKABLACK #4300, manufactured by Tokai Carbon Co., Ltd.), and 15.3 parts by mass of urethane resin microparticles (product name: Art Pearl C-400, manufactured by Negami Chemical Industrial Co., Ltd.). Next, methylethylketone was added so that the total solid content ratio became 30 mass %, and then the mixture was mixed with a sand mill. Subsequently, the viscosity was adjusted to be 10 to 12 cps with methylethylketone, and thus, the coating for forming the surface layer was prepared.

(Formation of Surface Layer)

The elastic roller D-1 previously manufactured was immersed in the coating for forming the surface layer, and a coating film of the coating was formed and dried on the surface of the elastic layer of the elastic roller D-1.

Furthermore, another heating treatment was performed at 150° C. for an hour, so that the surface layer with a thickness of approximately 15 μm was provided at the outer periphery of the elastic roller; thus, an electrophotographic roller according to Example 1 was manufactured. For the obtained electrophotographic roller, GC-MS analysis and $^{1}$H-NMR analysis were performed. Thus, it has been demonstrated that there are the n-octylene structure derived from the polyol compound P-1, and the sulfonic acid group and the imidazolium group derived from the ionic compound IP-1.

(Manufacture of Resin Sheet for Physical Property Measurement)

The coating for forming the surface layer was casted in an aluminum mold so that the film thickness became 200 μm. Then, the coating was dried on a sunflower frame (product name: Wander Shaker NA-4X (manufactured by Nissinrika)) until the fluidity was lost. After that, the coating was placed on a horizontal table, and dried at an atmospheric temperature of 23° C. for 24 hours, and then thermally cured at 140° C. for two hours and cooled down to room temperature. After that, the cured substance was released from the aluminum mold, and thus the resin sheet with a thickness of 200 μm was manufactured.

<Evaluation on Resin Sheet for Physical Property Measurement>

(Tackiness Test)

The resin sheet for physical property measurement was placed for one week under an environment of a temperature of 40° C. and a humidity of 95% RH. After that, under the same environment, the adhesion strength of the outermost layer surface of the resin sheet for physical property measurement was measured using a tackiness test machine TAC-II (manufactured by RHESCA Co., LTD.). The measurement was performed with a preload of 400 gf, a pushing speed of 30 mm/min, a pushing load of 400 gf, a pushing time of 5 seconds, and a pulling speed of 600 mm/min, using a probe made of stainless steel that has a cylindrical shape with a diameter ϕ of 5.1 mm. The adhesion strength was the average value of five measurement values (peak values).

(Tensile Strength)

The tensile strength was measured in accordance with the method according to JIS-K6251. In the measurement, a universal testing machine, (product name: TENSILON RTC-1250A, manufactured by A&D Company, Limited) was used. The measurement environment was a temperature of 23° C. and a humidity of 55% RH. From the resin sheet for physical property measurement that was left at a temperature of 23° C. and a humidity of 55% RH for 24 hours or more, a test piece with a dumbbell shape #2 according to JIS-K6251 was cut out in advance. With a thickness gauge, the thickness of a central parallel part of the test piece was measured at three points, and a central value thereof was regarded as the thickness of the test piece.

In addition, the width of the central parallel part of the test piece was measured at three points, and a central value thereof was regarded as the width of the test piece. From the obtained thickness and width of the test piece, the cross-sectional area of the test piece was calculated according to the following expression:

Cross-sectional area of test piece=thickness of test piece×width of test piece

Each end of this test piece with a length of 10 mm was attached to a chuck of the universal testing machine, and then a tensile test was performed at a chuck moving speed of 500 mm/min. The test piece was pulled until the test piece was broken, and the value obtained by dividing the maximum recorded tensile force by the cross-sectional area of the test piece was regarded as the tensile strength of the test piece. From one resin sheet, five test pieces were cut out, and the measurement was performed five times; the central value was regarded as the measurement result.

(Urethane Bond Concentration)

By using a cryogenic sample crusher (product name: JFC-300, manufactured by Japan Analytical Industry Co., Ltd.), the obtained resin sheet for physical property measurement was crushed for 10 minutes while being cooled with liquid nitrogen; thus, a sample in a micropowder form was obtained. This sample was subjected to solid-state $^{1}$H-NMR analysis, and from an integrated value of the proton peak derived from the urethane bond, the quantity of the urethane bond concentration was determined.

<Evaluation as Developing Roller>

The obtained electrophotographic roller was evaluated as the developing roller in regard to the following items.

(Ion Immobilizing Ratio)

In order to obtain the ratio between the cationic structure and the anionic structure that are bound to the urethane resin and the cation and the anion that are not bound to the urethane resin in the surface layer, the following analysis was performed.

The electrophotographic roller was immersed in methylethylketone (MEK), and left for three days with the entire roller immersed therein. After the three days, the obtained immersion solution was dried and the extract was obtained. This extract was dissolved in deuteriochloroform and the mixture was subjected to $^{1}$H-NMR analysis. In the $^{1}$H-NMR analysis, a siloxane peak derived from the silicone elastic layer, a peak derived from the urethane resin, and a peak derived from the cation and the anion that are not bound to the urethane resin were observed. By comparing the integrated values of those peaks, the number of moles of the cations and the anions in the extract that are not bound to the urethane resin was calculated. (This number of moles is hereinafter A.)

On the other hand, the number of moles B that is defined as below can be calculated from the mass of the surface layer and the mixing ratio of the ionic compound shown in Table 6.

The number of moles B=the total of the cationic structure and the anionic structure that are bound to the urethane resin and the cations and the anions that are not bound to the urethane resin in the surface layer.

On the basis of the number of moles A and the number of moles B obtained as above, the ion immobilizing ratio was obtained from the following expression:

$$\text{Ion immobilizing ratio}=(B-A)/B\times 100(\%)$$

(Md-1 Hardness)

By using a micro-rubber hardness tester MD-1 (manufactured by KOBUNSHI KEIKI CO., LTD.) that was installed in an environment of a temperature of 23° C. and a humidity of 50% RH, the micro-rubber hardness was measured at three points including a central position of the electrophotographic roller and positions of 30 mm from both ends thereof. The average value of these three points was obtained and regarded as the MD-1 hardness of the electrophotographic roller.

(Evaluation on Toner Adhesion Stripes)

When the tackiness of the surface of the developing roller is high, the toner may adhere to the surface of the developing roller depending on use conditions. At the place where the toner adhesion occurs, the toner conveyance varies locally. Therefore, on an image where the cartridge is used initially, vertical black stripes called toner adhesion stripes appear. The toner adhered on the surface of the developing roller may be gradually scraped off and reduced as the developing roller rubs with the developing blade or the toner-supplying roller. In this case, as sheets are printed more, the toner adhesion stripes on the image will disappear.

In view of the above points, the toner adhesion stripes were evaluated in accordance with the following procedure.

To a black toner cartridge of a laser printer (product name: LBP5300, manufactured by Canon Inc.), the manufactured electrophotographic roller was attached as the developing roller. This black toner cartridge was loaded into the laser printer. Then, an operation of outputting a white solid image was performed using this laser printer, and the black toner was brought into contact with the surface of the developing roller. This toner cartridge was left for 60 days under an environment of an atmospheric temperature of 40° C. and a relative humidity of 95% RH. Then, the toner cartridge was left at rest for 12 hours under an environment of a temperature of 25° C. and a relative humidity of 45% RH.

The developing roller was taken out of the toner cartridge and loaded into a new black toner cartridge. A halftone image with uniform concentration was successively printed in the entire image on a sheet of paper with a size of A4. In regard to this image, the number of sheets that were printed until the toner adhesion stripes disappeared was checked. In a case where the toner adhesion stripes were not formed from the first sheet, this number of sheets was 0.

(Evaluation on Filming and Toner Leak)

If the flexibility of the developing roller is insufficient, damages may be accumulated easily in the toner that is in contact with the developing roller due to the friction load.

Therefore, depending on the use conditions, toner filming may occur. In addition, if the wear resistance is insufficient, the developing roller surface may wear out due to the long-term use. As the developing roller is in contact with the developing blade, the toner restriction force decreases and the toner leak may occur easily.

In view of the above, the following examination was carried out in order to evaluate the filming and the toner leak. Under an environment of an atmospheric temperature of 0° C., the manufactured electrophotographic roller was loaded as the developing roller into a black toner cartridge of a laser printer (product name LBP5300, manufactured by Canon Inc.), and 10000 sheets of paper were printed successively at a coverage rate of 1%. After that, a halftone image with the uniform concentration in the entire image was output and the unevenness in concentration due to the filming was evaluated. In regard to the unevenness in concentration, whether the concentration in the vicinity in the same image was uneven was first checked visually. After that, the maximum value of the concentration difference in the vicinity in the uneven concentration part was measured using a reflection densitometer (product name: GretagMacbeth RD918, manufactured by Macbeth).

After that, the successive printing at a coverage rate of 1% was restarted under the environment of 0° C. The toner cartridge was taken out every time 1000 sheets of paper were printed, and the contact part between the developing roller and the developing blade was observed, and the number of sheets that were printed until the toner leak was observed was defined as a toner leak occurrence number of sheets. If the toner leak occurred before 10000 sheets of paper were printed, the number of sheets at that time point was regarded as the toner leak occurrence number of sheets, and the filming evaluation was not carried out.

Examples 2 to 38

Developing rollers and resin sheets for physical property measurement according to Examples 2 to 38 were manufactured in a manner similar to Example 1 except that the kind of and the mixing amount of the urethane prepolymer, the polyol compound, and the ionic compound were changed as shown in Table 6. Then, the evaluation similar to that in Example 1 was performed.

Comparative Examples 1 to 4

Developing rollers and resin sheets for physical property measurement according to Comparative Examples 1 to 4 were manufactured in a manner similar to Example 1 except that the kind of and the mixing amount of the urethane prepolymer, the polyol compound, and the ionic compound were changed as shown in Table 6. Then, the evaluation similar to that in Example 1 was performed.

TABLE 6

| | Prepolymer | | Polyol compound | | Ionic compound | |
|---|---|---|---|---|---|---|
| | No. | Parts by mass | No. | Parts by mass | No. | Parts by mass |
| Example 1 | U-1 | 49.1 | P-1 | 50.9 | IP-1 | 0.25 |
| Example 2 | U-1 | 49.1 | P-1 | 50.9 | IP-2 | 0.30 |
| Example 3 | U-1 | 49.1 | P-1 | 50.9 | IP-3 | 0.74 |
| Example 4 | U-1 | 49.1 | P-1 | 50.9 | IP-4 | 0.31 |
| Example 5 | U-1 | 49.1 | P-1 | 50.9 | IP-5 | 0.37 |
| Example 6 | U-1 | 49.1 | P-1 | 50.9 | IP-6 | 0.81 |
| Example 7 | U-2 | 54.7 | P-2 | 45.3 | IP-1 | 0.25 |
| Example 8 | U-2 | 54.7 | P-2 | 45.3 | IP-2 | 0.30 |
| Example 9 | U-3 | 49.1 | P-3 | 50.9 | IP-1 | 0.25 |
| Example 10 | U-3 | 49.1 | P-3 | 50.9 | IP-2 | 0.30 |
| Example 11 | U-2 | 54.7 | P-2 | 45.3 | IP-4 | 0.31 |
| Example 12 | U-2 | 54.7 | P-2 | 45.3 | IP-5 | 0.37 |
| Example 13 | U-2/U-10 | 32.0/22.7 | P-2/P-10 | 26.5/18.8 | IP-1 | 0.25 |
| Example 14 | U-2/U-10 | 6.5/48.2 | P-2/P-10 | 5.4/39.9 | IP-1 | 0.25 |
| Example 15 | U-2/U-10 | 3.2/51.5 | P-2/P-10 | 2.7/42.6 | IP-1 | 0.25 |
| Example 16 | U-4 | 49.1 | P-4 | 50.9 | IP-1 | 0.25 |
| Example 17 | U-5 | 49.1 | P-5 | 50.9 | IP-1 | 0.25 |
| Example 18 | U-6 | 49.1 | P-6 | 50.9 | IP-1 | 0.25 |
| Example 19 | U-7 | 54.7 | P-7 | 45.3 | IP-1 | 0.25 |
| Example 20 | U-7 | 54.7 | P-7 | 45.3 | IP-4 | 0.31 |
| Example 21 | U-8 | 70.7 | P-8 | 29.3 | IP-1 | 0.25 |
| Example 22 | U-8 | 70.7 | P-8 | 29.3 | IP-1 | 0.25 |
| Example 23 | U-9 | 46.3 | P-9 | 53.7 | IP-1 | 0.25 |
| Example 24 | U-10 | 49.1 | P-10 | 50.9 | IP-1 | 0.25 |
| Example 25 | U-1 | 49.1 | P-1 | 50.9 | IP-1/IP-13 | 0.18/0.04 |
| Example 26 | U-1 | 49.1 | P-1 | 50.9 | IP-1/IP-13 | 0.13/0.06 |
| Example 27 | U-1 | 49.1 | P-1 | 50.9 | IP-7 | 0.26 |
| Example 28 | U-1 | 49.1 | P-1 | 50.9 | IP-8 | 0.26 |
| Example 29 | U-1 | 49.1 | P-1 | 50.9 | IP-9 | 0.22 |
| Example 30 | U-1 | 49.1 | P-1 | 50.9 | IP-10 | 0.27 |
| Example 31 | U-1 | 49.1 | P-1 | 50.9 | IP-11 | 0.24 |
| Example 32 | U-2 | 54.7 | P-2 | 45.3 | IP-7 | 0.26 |
| Example 33 | U-2 | 54.7 | P-2 | 45.3 | IP-8 | 0.26 |
| Example 34 | U-1 | 49.1 | P-1 | 50.9 | IP-12 | 0.29 |
| Example 35 | U-1 | 49.1 | P-1 | 50.9 | IP-1 | 0.13 |
| Example 36 | U-1 | 49.1 | P-1 | 50.9 | IP-1 | 0.60 |
| Example 37 | U-11 | 82.8 | P-11 | 17.2 | IP-1 | 0.25 |
| Example 38 | U-12 | 32.5 | P-12 | 67.5 | IP-1 | 0.25 |

TABLE 6-continued

| | Prepolymer | | Polyol compound | | Ionic compound | |
|---|---|---|---|---|---|---|
| | No. | Parts by mass | No. | Parts by mass | No. | Parts by mass |
| Comparative Example 1 | U-1 | 49.1 | P-1 | 50.9 | — | — |
| Comparative Example 2 | U-13 | 54.7 | P-13 | 45.3 | IP-1 | 0.25 |
| Comparative Example 3 | U-14 | 54.7 | P-14 | 45.3 | IP-1 | 0.25 |
| Comparative Example 4 | U-2 | 54.7 | P-2 | 45.3 | IP-13 | 0.12 |

Comparative Example 5

As the resin including the amino group and the carboxylic acid group in the resin structure, the resin (product name: RAM resin-1000, manufactured by OSAKA ORGANIC CHEMICAL INDUSTRY LTD.) was used. RAM resin-1000 is the acrylic resin composition expressed by the following Structural Formula 36, and has a weight average molecular weight (Mw) of 80,000. In Structural Formula 36, 1=1 and m=1, $R^6$ represents an alkyl group.

(Structural Formula 36)

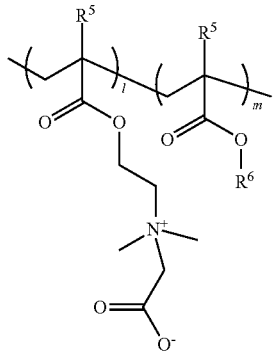

$R^5$: H or $CH_3$
$R^6$: Alkyl

Next, 100 parts by mass of RAM resin-1000 (solid content), 15.0 parts by mass of carbon black (product name: TOKABLACK #4300, manufactured by Tokai Carbon Co., Ltd.), and 15.3 parts by mass of urethane resin microparticles (product name: Art Pearl C-400, manufactured by Negami Chemical Industrial Co., Ltd.) were mixed. Then, ethanol was added thereto so that the total solid content ratio became 30 mass %, and the mixture was mixed with a sand mill. Furthermore, the viscosity was adjusted to be 10 to 12 cps with ethanol, and thus the coating for forming the surface layer was prepared.

With the use of this coating for forming the surface layer, a developing roller and a resin sheet for physical property measurement according to Comparative Example 5 were manufactured through a procedure similar to that of Example 1. Then, the evaluation similar to that of Example 1 was performed. The results of Examples and Comparative Examples obtained by the above evaluation tests are shown in Tables 7-1 to 7-3.

TABLE 7-1

| | | Evaluation result | | | | | | | |
|---|---|---|---|---|---|---|---|---|---|
| | | Tackiness test (kN/m2) | Tensile strength (MPa) | Urethane group concentration (mmol/g) | Ion immobilizing ratio (%) | MD-1 hardness | The number of sheets printed until toner adhesion stripes disappear | Filming evaluation (concentration difference) | Toner leak occurrence number of sheets |
| Examples | 1 | 3.8 | 19.2 | 0.61 | 95 | 38.4 | 0 | 0.02 | 15000 |
| | 2 | 4.1 | 19.9 | 0.58 | 95 | 38.1 | 0 | 0.03 | 15000 |
| | 3 | 4.6 | 20.8 | 0.61 | 96 | 38.4 | 0 | 0.01 | 15000 |
| | 4 | 4.2 | 20.4 | 0.62 | 93 | 38.8 | 0 | 0.02 | 15000 |
| | 5 | 4.0 | 18.9 | 0.61 | 95 | 38.1 | 0 | 0.02 | 15000 |
| | 6 | 4.2 | 17.6 | 0.61 | 92 | 38.3 | 0 | 0.02 | 15000 |
| | 7 | 6.8 | 19.8 | 0.74 | 91 | 39.6 | 0 | 0.03 | 15000 |
| | 8 | 6.7 | 20.6 | 0.75 | 91 | 39.2 | 0 | 0.04 | 15000 |
| | 9 | 4.1 | 15.2 | 0.60 | 95 | 39.2 | 0 | 0.03 | 13000 |
| | 10 | 4.4 | 15.8 | 0.61 | 96 | 39.1 | 0 | 0.02 | 13000 |
| | 11 | 6.6 | 24.6 | 0.74 | 96 | 39.9 | 0 | 0.02 | 17000 |
| | 12 | 6.1 | 22.0 | 0.74 | 94 | 39.8 | 0 | 0.02 | 16000 |
| | 13 | 9.8 | 25.8 | 0.73 | 96 | 40.2 | 2 | 0.03 | 18000 |
| | 14 | 12.1 | 26.4 | 0.74 | 95 | 40.6 | 1 | 0.02 | 18000 |
| | 15 | 14.7 | 27.3 | 0.74 | 92 | 44.4 | 5 | 0.08 | 18000 |

TABLE 7-1-continued

| | | Evaluation result | | | | | | | |
|---|---|---|---|---|---|---|---|---|---|
| | | Tackiness test (kN/m2) | Tensile strength (MPa) | Urethane group concentration (mmol/g) | Ion immobilizing ratio (%) | MD-1 hardness | The number of sheets printed until toner adhesion stripes disappear | Filming evaluation (concentration difference) | Toner leak occurrence number of sheets |
| | 16 | 5.1 | 20.8 | 0.62 | 95 | 38.4 | 0 | 0.02 | 15000 |
| | 17 | 4.5 | 19.8 | 0.66 | 94 | 38.1 | 0 | 0.03 | 15000 |
| | 18 | 4.3 | 16.1 | 0.61 | 95 | 37.8 | 0 | 0.03 | 13000 |

TABLE 7-2

| | | Evaluation result | | | | | | | |
|---|---|---|---|---|---|---|---|---|---|
| | | Tackiness test (kN/m2) | Tensile strength (MPa) | Urethane group concentration (mmol/g) | Ion immobilizing ratio (%) | MD-1 hardness | The number of sheets printed until toner adhesion stripes disappear | Filming evaluation (concentration difference) | Toner leak occurrence number of sheets |
| Examples | 19 | 6.1 | 19.3 | 0.76 | 95 | 39.6 | 0 | 0.02 | 15000 |
| | 20 | 6.9 | 18.0 | 0.74 | 93 | 39.0 | 0 | 0.02 | 15000 |
| | 21 | 7.1 | 18.8 | 1.41 | 91 | 38.9 | 0 | 0.02 | 15000 |
| | 22 | 6.8 | 20.4 | 1.45 | 94 | 39.5 | 0 | 0.02 | 15000 |
| | 23 | 4.4 | 28.0 | 0.54 | 91 | 44.3 | 0 | 0.06 | 18000 |
| | 24 | 4.2 | 29.2 | 0.62 | 92 | 43.7 | 0 | 0.06 | 18000 |
| | 25 | 10.5 | 16.9 | 0.61 | 71 | 37.4 | 2 | 0.03 | 14000 |
| | 26 | 15.0 | 17.6 | 0.61 | 52 | 37.1 | 5 | 0.02 | 15000 |
| | 27 | 8.2 | 17.7 | 0.59 | 93 | 38.9 | 3 | 0.03 | 15000 |
| | 28 | 8.2 | 19.8 | 0.60 | 95 | 39.1 | 4 | 0.02 | 16000 |
| | 29 | 8.9 | 20.1 | 0.61 | 96 | 39.5 | 3 | 0.02 | 15000 |
| | 30 | 8.7 | 20.3 | 0.62 | 95 | 38.8 | 3 | 0.03 | 16000 |
| | 31 | 9.0 | 19.3 | 0.62 | 95 | 38.6 | 2 | 0.02 | 16000 |
| | 32 | 9.7 | 19.8 | 0.75 | 95 | 38.8 | 4 | 0.02 | 15000 |
| | 33 | 9.6 | 19.5 | 0.75 | 94 | 38.9 | 2 | 0.04 | 15000 |
| | 34 | 5.7 | 16.4 | 0.62 | 93 | 36.7 | 0 | 0.03 | 14000 |
| | 35 | 8.8 | 18.6 | 0.61 | 95 | 38.1 | 2 | 0.02 | 15000 |
| | 36 | 3.1 | 21.1 | 0.62 | 96 | 38.3 | 0 | 0.03 | 15000 |
| | 37 | 3.0 | 35.4 | 2.22 | 96 | 45.7 | 0 | 0.09 | 19000 |
| | 38 | 12.5 | 14.9 | 0.32 | 95 | 36.1 | 3 | 0.03 | 12000 |

TABLE 7-3

| | | Evaluation result | | | | | | | |
|---|---|---|---|---|---|---|---|---|---|
| | | Tackiness test (kN/m2) | Tensile strength (MPa) | Urethane group concentration (mmol/g) | Ion immobilizing ratio (%) | MD-1 hardness | The number of sheets printed until toner adhesion stripes disappear | Filming evaluation (concentration difference) | Toner leak occurrence number of sheets |
| Comparative Example | 1 | 20.1 | 20.3 | 0.61 | — | 39.2 | 55 | 0.02 | 15000 |
| | 2 | 18.1 | 20.1 | 0.74 | 96 | 39.4 | 48 | 0.03 | 15000 |
| | 3 | 17.2 | 19.6 | 0.73 | 95 | 38.4 | 46 | 0.02 | 15000 |
| | 4 | 19.8 | 17.9 | 0.72 | 0 | 36.2 | 51 | 0.02 | 15000 |
| | 5 | 16.9 | 2.8 | — | 94 | 28 | 31 | Evaluation failed because of toner leak | 50 |

In Examples 1 to 38, the urethane resin forming the surface layer had the structure expressed by Structural Formula 1 to Structural Formula 4 according to the present invention, and further had the cationic structure and the anionic structure that are covalently bound to the urethane resin. Therefore, in Examples 1 to 38, the flexibility, the wear resistance, and the low tackiness were all achieved, the toner adhesion amount was small, the filming was suppressed, and the number of sheets that were printed until toner leak occurred was large.

Above all, in the following examples, the number of sheets that were printed until toner leak occurred was 14000 or more and the wear resistance was particularly high:

Examples 1 to 8, 11 to 17, 19 to 22, and 25 to 37 in which polyol including an ether chain, an ester chain, or a carbonate chain with 8 or less carbons was used; and Examples 23 and 24 in which polyolefin polyol was used.

As compared to Examples 27 to 31 in which the cationic structure that is non-aromatic was used, the toner adhesion was suppressed at higher level in Examples 1 to 6 in which the cationic structure that is aromatic was used. Moreover, as compared to Example 35 in which the amount of cationic structure or anionic structure that was included in the resin surface layer was small, the toner adhesion was suppressed at higher level in Example 36 in which the amount of cationic structure or anionic structure was large.

On the other hand, the tackiness of the resin was high and the toner adhesion amount was not suppressed in the following comparative examples:

Comparative Example 1 in which the urethane resin forming the surface layer did not contain the ionic compound;

Comparative Examples 2 and 3 in which the urethane resin had a main-chain structure with low hydrophobicity; and Comparative Example 4 in which the cationic structure and the anionic structure were not bound to the urethane resin.

In Comparative Example 5 in which the cationic structure and the anionic structure were bound to the urethane resin, the tensile strength and the MD-1 hardness were low, the number of sheets that were printed until toner leak occurred was 50, and the filming performance was not evaluated.

Example 39

Synthesis of Polyester Polyamide AM-1

In a reaction container, 292.5 g (2 moles) of 1,8-octane diol (manufactured by Tokyo Chemical Industry Co., Ltd.), 438.4 g (3 moles) of adipic acid (manufactured by Tokyo Chemical Industry Co., Ltd.), and 24.6 g (0.1 moles) of ionic compound IP-1 were mixed, and the mixture was subjected to reaction at 200° C. for four hours in the nitrogen atmosphere. To this reactant, 232.4 g (2 moles) of 1,6-hexamethylene diamine (manufactured by Tokyo Chemical Industry Co., Ltd.) and 146.1 g (1 mole) of adipic acid were mixed, and the mixture was subjected to reaction at 240° C. for four hours in the nitrogen atmosphere. After the mixture was cooled to room temperature, the obtained resin was washed with methanol, and immersed into another 10-L methanol for three days and the unreacted component was eluted. After that, water and the solvent component that were left were removed under the reduced pressure, and thus, polyester polyamide resin AM-1 expressed by the following Structural Formula 37 was obtained.

[Structural Formula 37]

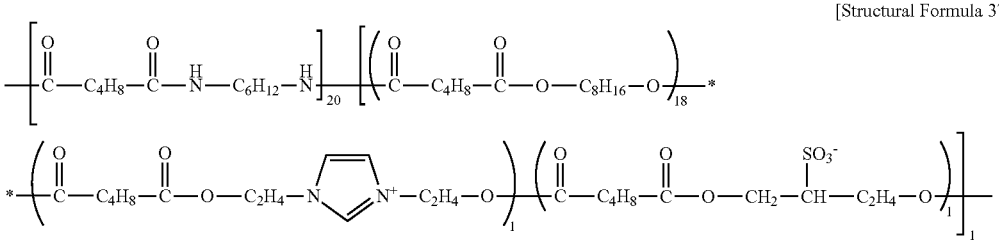

Into a kneader, 100 parts by mass of polyester polyamide resin AM-1 and 15.0 parts by mass of carbon black (product name: TOKABLACK #4300, manufactured by Tokai Carbon Co., Ltd.) were put, and the mixture was kneaded at 160° C. for 20 minutes; thus, a thermoplastic elastomer composition was obtained. Next, this thermoplastic elastomer composition was put into a uniaxial extruder, and melted at temperatures of 160° C. to 200° C. From a nozzle at an end of the extruder, the melted strand-shaped mixture was extruded, cooled, and cut, so that a pellet was obtained.

This pellet of the thermoplastic elastomer composition was melted at 200° C. and the thermoplastic elastomer composition was extruded and molded onto an SUS plate with a thickness of 0.08 mm corresponding to the support member, so that the electrophotographic blade was manufactured.

(Manufacture of Resin Sheet for Physical Property Measurement)

The polyester polyamide resin AM-1 was put into a sheet mold with a thickness of 2.0 mm, and vulcanized for 10 minutes by a thermal press that was heated at 200° C. Then, the resin was cooled to room temperature and thus, the resin sheet for physical property measurement was manufactured.

<Evaluation of Resin Sheet for Physical Property Measurement>

(Tackiness Test)

The manufactured resin sheet for physical property measurement was left for one week under an environment of a temperature of 40° C. and a humidity of 95% RH. After that, the resin sheet for physical property measurement was left for an hour under an environment of a temperature of 25° C. and a relative humidity of 45%. The adhesion strength of a surface of the developing blade was measured under the same environment by using a tackiness test machine TAC-II (manufactured by RHESCA Co., LTD.). The measurement was performed with a preload of 400 gf, a pushing speed of 30 mm/min, a pushing load of 400 gf, a pushing time of 5 seconds, and a pulling speed of 600 mm/min, using a probe made of stainless steel that has a cylindrical shape with a diameter ϕ of 5.1 mm. The adhesion strength was the average value of five measurement values (peak values).

(Tensile Strength)

The tensile strength was measured in accordance with a method described in Japanese Industrial Standard (JIS) K6251:2017. In the measurement, a universal testing machine, (product name: TENSILON RTC-1250A, manufactured by A&D Company, Limited) was used. The measurement environment was a temperature of 23° C. and a humidity of 55% RH. From the resin sheet for physical property measurement that was left at a temperature of 23° C. and a humidity of 55% RH for 24 hours or more, a test piece with a dumbbell shape #2 according to JIS K6251: 2017 was cut out in advance. With a thickness gauge, the thickness of a central parallel part of the test piece was measured at three points, and a central value thereof was regarded as the thickness of the test piece. In addition, the width of the central parallel part of the test piece was measured at three points, and a central value thereof was regarded as the width of the test piece. From the obtained thickness and width of the test piece, the cross-sectional area of the test piece was calculated according to the following expression:

Cross-sectional area of test piece=thickness of test piece×width of test piece

Each end of this test piece with a length of 10 mm was attached to a chuck of the universal testing machine, and then a tensile test was performed at a chuck moving speed of 500 mm/min. The test piece was pulled until the test piece was broken, and the value obtained by dividing the maximum recorded tensile force by the cross-sectional area of the test piece was regarded as the tensile strength of the test piece. From one resin sheet, five test pieces were cut out, and the measurement was performed five times; the central value was regarded as the measurement result.

(Amide Bond Concentration and Content Amount of Cationic Structure/Anionic Structure)

By using a cryogenic sample crusher (product name: JFC-300, manufactured by Japan Analytical Industry Co., Ltd.), the obtained resin sheet for physical property measurement was crushed for 10 minutes while being cooled with liquid nitrogen; thus, a sample in a micropowder form was obtained. This sample was subjected to solid-state $^{1}$H-NMR analysis, and from an integrated value of the proton peak derived from the amide bond, the quantity of the amide bond concentration was determined. In addition, the content amount of cationic structure and anionic structure was calculated based on the integrated values of the proton peaks derived from the cationic structure and the anionic structure.

<Evaluation as Developing Blade>

The obtained electrophotographic blade was evaluated as the developing blade in regard to the following items.

(Ion Immobilizing Ratio)

In order to obtain the ratio between the cationic structure and the anionic structure that are bound to the amide resin and the cation and the anion that are not bound to the amide resin in the surface layer, the following analysis was performed. The developing blade was immersed in MEK, and left for three days at 25° C. with the entire blade immersed therein. After the three days, the obtained immersion solution was dried and the extract was obtained. This extract was dissolved in deuteriochloroform and the mixture was subjected to $^{1}$H-NMR analysis. In the $^{1}$H-NMR analysis, a peak derived from the amide resin, and peaks derived from the cations and anions that are not bound to the amide resin were observed. By comparing the integrated values of those peaks, the number of moles of the cations and the anions in the extract that are not bound to the amide resin was calculated. (This number of moles is hereinafter A.)

On the other hand, the number of moles B that is defined as below can be calculated from the mass of the surface layer and the content amount of the cationic structure and the anionic structure that are obtained in the solid-state $^{1}$H-NMR analysis.

The number of moles B=the total number of moles of the cationic structure and the anionic structure that are bound to the amide resin and the cations and the anions that are not bound to the amide resin in the surface layer.

On the basis of the number of moles A and the number of moles B obtained as above, the immobilizing ratio was obtained from the following expression:

$$\text{Ion immobilizing ratio}=(B-A)/B\times 100(\%)$$

(Evaluation on Toner Adhesion Stripes)

When the tackiness of the surface of the developing blade is high, the toner may adhere to the surface of the developing blade depending on use conditions. At the place where the toner adhesion occurs, the toner conveyance varies locally. Therefore, on an image where the cartridge is used initially, vertical black stripes called toner adhesion stripes appear. The toner adhered on the surface of the developing blade may be gradually scraped off and reduced as the developing blade rubs with the developing roller. In this case, as sheets are printed more, the toner adhesion stripes on the image will disappear.

In view of the above points, the toner adhesion stripes were evaluated in accordance with the following procedure.

To a black toner cartridge of a laser printer (product name: LBP5300, manufactured by Canon Inc.), the manufactured electrophotographic blade was attached as the developing blade. This black toner cartridge was loaded into the laser printer. Then, an operation of outputting a white solid image was performed using this laser printer, and the black toner was brought into contact with the surface of the developing blade. This toner cartridge was left for 60 days under an environment of an atmospheric temperature of 40° C. and a relative humidity of 95% RH. Then, the toner cartridge was left at rest for 12 hours under an environment of a temperature of 25° C. and a relative humidity of 45% RH.

The developing blade was taken out of the toner cartridge and loaded into a new black toner cartridge. A halftone image with uniform concentration was successively printed in the entire image on a sheet of paper with a size of A4. In regard to this image, the number of sheets that were printed until the toner adhesion stripes disappeared was checked. In a case where the toner adhesion stripes were not formed from the first sheet, this number of sheets was 0.

(Evaluation on Development Stripes and Toner Leak)

If the flexibility of the developing blade is insufficient, damages may be accumulated easily in the toner that is in contact with the developing blade due to the friction load. Therefore, depending on the use conditions, the deteriorated toner may be melted on the blade and an image failure with a vertical stripe shape called development stripes may occur. In addition, if the wear resistance is insufficient, the developing blade surface may wear out due to the long-term use. As the developing blade is in contact with the developing roller, the toner restriction force decreases and the toner leak may occur.

In view of the above, the following examination was carried out in order to evaluate the development stripes and the toner leak. Under an environment of an atmospheric temperature of 0° C., the manufactured developing blade was loaded into a black toner cartridge of a laser printer (product name LBP5300, manufactured by Canon Inc.). After 10000 sheets of paper were printed successively at a coverage rate of 1%, the developing blade was taken out and the toner on the surface was removed. Then, a solid black image was output onto a sheet of paper with a size of A4, and how many development stripes (vertical white stripes) with a width of 0.2 mm or more appeared in the image was checked.

Examples 40 to 45

Synthesis of Polyester Polyamide AM-2

Polyester polyamide resin AM-2 was obtained through a procedure similar to that of synthesizing AM-1 except that 24.6 g (0.1 moles) of the ionic compound IP-1 was changed to 30.4 g (0.1 moles) of the ionic compound IP-2. The polyester polyamide AM-2 is the compound expressed by the following average Structural Formula 38.

(Structural Formula 38)

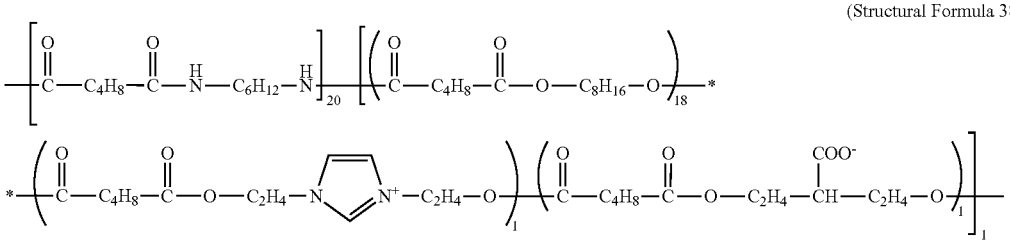

Synthesis of Polyether Polyamide AM-3

In a reaction container, 236.4 g (2 moles) of 3-methyl-1, 5-pentane diol (manufactured by Tokyo Chemical Industry Co., Ltd.), 438.4 g (3 moles) of adipic acid (manufactured by Tokyo Chemical Industry Co., Ltd.), and 24.6 g (0.1 moles) of ionic compound IP-1 were mixed, and the mixture was subjected to reaction at 200° C. for four hours in the nitrogen atmosphere. To this reactant, 464.8 g (4 moles) of 1,6-hexamethylene diamine (manufactured by Tokyo Chemical Industry Co., Ltd.) and 438.4 g (3 moles) of adipic acid were added. The mixture was subjected to reaction at 240° C. for four hours in the nitrogen atmosphere.

After the mixture was cooled to room temperature, the obtained resin was washed with methanol, and immersed into another 10-L methanol for three days and the unreacted component was eluted. After that, water and the solvent component that were left were removed under the reduced pressure, and thus, polyester polyamide resin AM-3 expressed by the following average Structural Formula 39 was obtained.

(Structural Formula 39)

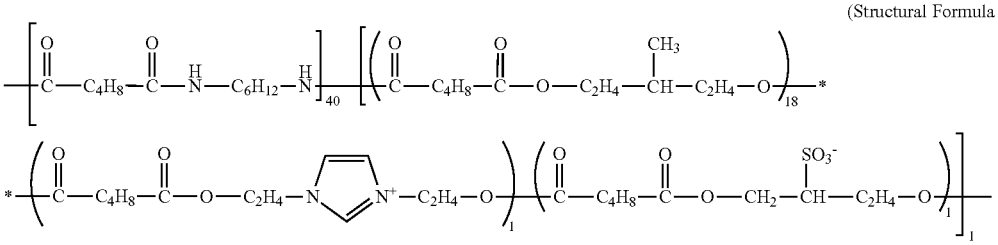

Synthesis of Polyester Polyamide AM-4

In a reaction container, 236.4 g (2 moles) of 3-methyl-1, 5-pentane diol (manufactured by Tokyo Chemical Industry Co., Ltd.), 438.4 g (3 moles) of adipic acid (manufactured by Tokyo Chemical Industry Co., Ltd.), and 30.4 g (0.1 moles) of ionic compound IP-2 were mixed, and the mixture was subjected to reaction at 200° C. for four hours in the nitrogen atmosphere. To this reactant, 93.0 g (0.8 moles) of 1,6-hexamethylene diamine (manufactured by Tokyo Chemical Industry Co., Ltd.) was added. The mixture was subjected to reaction at 240° C. for four hours in the nitrogen atmosphere. After the mixture was cooled to room temperature, the obtained resin was washed with methanol, and immersed into another 10-L methanol for three days and the unreacted component was eluted. After that, water and the solvent component that were left were removed under the reduced pressure, and thus, polyester polyamide resin AM-4 expressed by the following average Structural Formula 40 was obtained.

(Structural Formula 40)

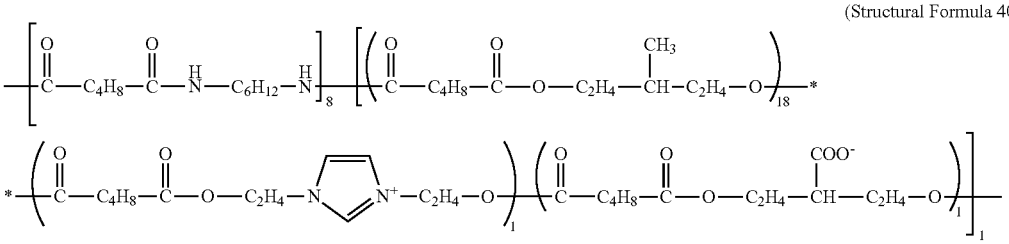

Synthesis of Polyester Polyamide AM-5

Polyester polyamide resin AM-5 was obtained through a procedure similar to that of synthesizing AM-3 except that 24.6 g (0.1 moles) of the ionic compound IP-1 was changed to 22.4 g (0.1 moles) of the ionic compound IP-9. The polyester polyamide AM-5 is the compound expressed by the following average Structural Formula 41.

(Structural Formula 41)

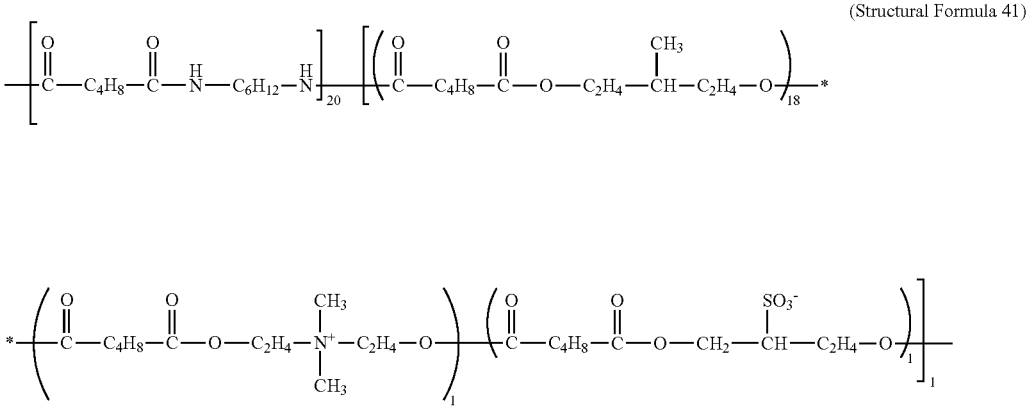

Synthesis of Polyester Polyamide AM-6

In a reaction container, 73.1 g (0.5 moles) of 1,8-octane diol (manufactured by Tokyo Chemical Industry Co., Ltd.), 116.9 g (0.8 moles) of adipic acid (manufactured by Tokyo Chemical Industry Co., Ltd.), and 24.6 g (0.1 moles) of ionic compound IP-1 were mixed, and the mixture was subjected to reaction at 200° C. for four hours in the nitrogen atmosphere. To this reactant, 1162.0 g (10 moles) of 1,6-hexamethylene diamine (manufactured by Tokyo Chemical Industry Co., Ltd.) and 1315.3 g (9 moles) of adipic acid were added. The mixture was subjected to reaction at 240° C. for four hours in the nitrogen atmosphere. After the mixture was cooled to room temperature, the obtained resin was washed with methanol, and immersed into another 20-L methanol for three days and the unreacted component was eluted. After that, water and the solvent component that were left were removed under the reduced pressure, and thus, polyester polyamide resin AM-6 expressed by the following average Structural Formula 42 was obtained.

(Structural Formula 42)

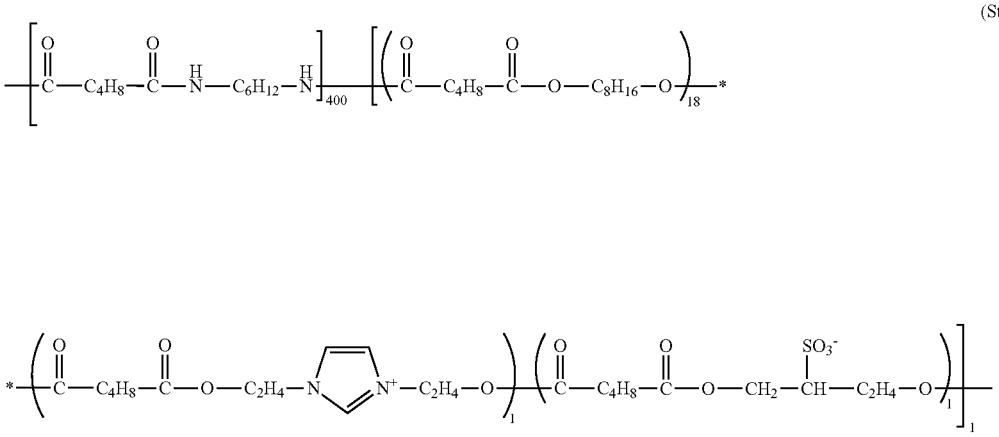

Synthesis of Polyester Polyamide AM-7

In a reaction container, 292.5 g (2 moles) of 1,8-octane diol (manufactured by Tokyo Chemical Industry Co., Ltd.), 438.4 g (3 moles) of adipic acid (manufactured by Tokyo Chemical Industry Co., Ltd.), and 24.6 g (0.1 moles) of ionic compound IP-1 were mixed, and the mixture was subjected to reaction at 200° C. for four hours in the nitrogen atmosphere. To this reactant, 58.1 g (0.5 moles) of 1,6-hexamethylene diamine (manufactured by Tokyo Chemical Industry Co., Ltd.) was added. The mixture was subjected to reaction at 240° C. for four hours in the nitrogen atmosphere. After the mixture was cooled to room temperature, the obtained resin was washed with methanol, and immersed into another 10-L methanol for three days and the unreacted component was eluted. After that, water and the solvent component that were left were removed under the reduced pressure, and thus, polyester polyamide resin AM-7 expressed by the following average Structural Formula 43 was obtained.

(Structural Formula 43)

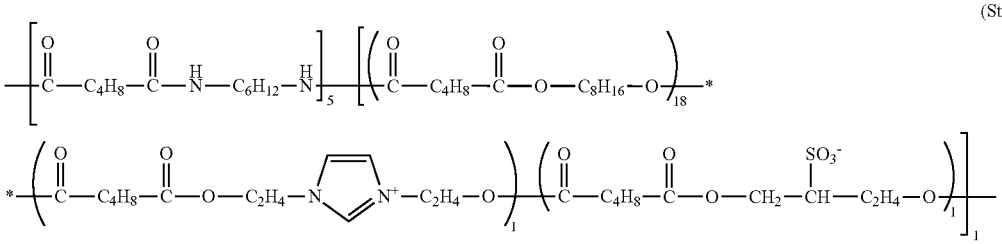

Developing blades according to Examples 40 to 45 were manufactured in a manner similar to Example 39 except that the polyester polyamide resin AM-1 was changed to AM-2 to AM-7. Then, the evaluation similar to that of Example 39 was performed.

Comparative Example 6

Synthesis of Polyester Polyamide AM-8

In a reaction container, 180.2 g (2 moles) of 1,4-butane diol (manufactured by Tokyo Chemical Industry Co., Ltd.), 354.3 g (3 moles) of succinic acid (manufactured by Tokyo Chemical Industry Co., Ltd.), and 24.6 g (0.1 moles) of ionic compound IP-1 were mixed, and the mixture was subjected to reaction at 200° C. for four hours in the nitrogen atmosphere. To this reactant, 232.4 g (2 moles) of 1,6-hexamethylene diamine (manufactured by Tokyo Chemical Industry Co., Ltd.) and 118.1 g (1 mole) of succinic acid were added. The mixture was subjected to reaction at 240° C. for four hours in the nitrogen atmosphere. After the mixture was cooled to room temperature, the obtained resin was washed with methanol, and immersed into another 10-L methanol for three days and the unreacted component was eluted. After that, water and the solvent component that were left were removed under the reduced pressure, and thus, polyester polyamide resin AM-8 expressed by the following average Structural Formula 44 was obtained.

(Structural Formula 44)

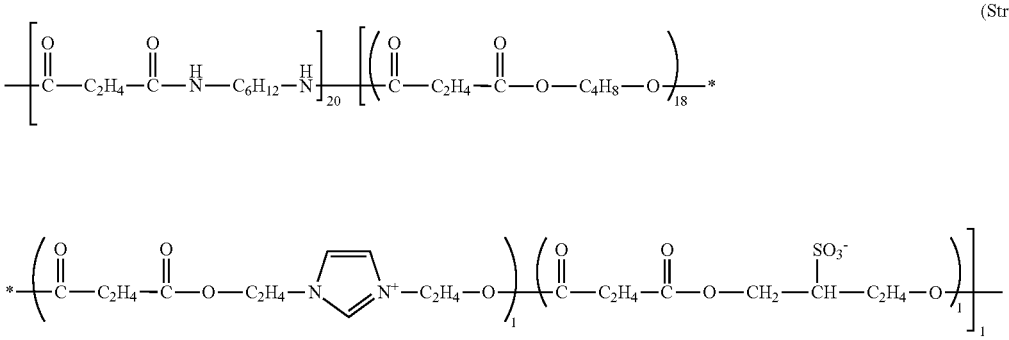

A developing blade according to Comparative Example 6 was manufactured in a manner similar to Example 39 except that the polyester polyamide resin AM-1 was changed to AM-8. Then, the evaluation similar to that of Example 39 was performed. The results of Examples and Comparative Example obtained from the above evaluation tests are shown in Table 8.

TABLE 8

| | Evaluation result | | | | | | | | | | |
|---|---|---|---|---|---|---|---|---|---|---|---|
| | | | Amide | Cation structure | | Anion structure | | | The number of sheets printed until | The number of sheets | Toner leak |
| | Tackiness test (kN/m2) | Tensile strength (MPa) | group concentration (mmol/g) | Cations | Cation concentration (mmol/g) | Anions | Anion concentration (mmol/g) | Ion immobilizing ratio (%) | toner adhesion stripes disappear | printed until development stripes appear | occurrence number of sheets |
| Example 39 | 4.3 | 35.2 | 2.06 | Imidazolium group | 0.10 | Sulfonic acid group | 0.10 | 91 | 0 | 0 | 15000 |
| Example 40 | 4.6 | 34.5 | 2.07 | Imidazolium group | 0.10 | Carboxylic acid group | 0.10 | 92 | 0 | 0 | 15000 |
| Example 41 | 4.3 | 38.1 | 2.93 | Imidazolium group | 0.07 | Sulfonic acid group | 0.07 | 91 | 0 | 0 | 16000 |
| Example 42 | 4.6 | 32.3 | 1.21 | Imidazolium group | 0.16 | Carboxylic acid group | 0.16 | 93 | 0 | 0 | 13000 |
| Example 43 | 9.2 | 35.6 | 2.06 | Ammonium group | 0.11 | Sulfonic acid group | 0.11 | 92 | 3 | 0 | 15000 |
| Example 44 | 2.8 | 41.5 | 4.20 | Imidazolium group | 0.01 | Sulfonic acid group | 0.01 | 95 | 0 | 2 | 16000 |
| Example 45 | 9.8 | 29.8 | 0.80 | Imidazolium group | 0.16 | Sulfonic acid group | 0.16 | 92 | 2 | 0 | 12000 |
| Comparative Example 6 | 16.9 | 35.1 | 2.64 | Imidazolium group | 0.13 | Sulfonic acid group | 0.13 | 95 | 51 | 0 | 15000 |

In Examples 39 to 45, the amide resin forming the surface layer had the structure expressed by Structural Formula 1 to Structural Formula 4 according to the present invention, and further had the cationic structure and the anionic structure that are covalently bound to the amide resin. Therefore, the tackiness was reduced and the toner adhesion was suppressed.

Above all, in Examples 39 to 42 in which the cation structure that is aromatic was used and Example 44 in which the resin contained many amide bonds, the toner adhesion was suppressed at higher level. On the other hand, in Comparative Example 6 in which the structure expressed by Structural Formula 1 to Structural Formula 4 was not used, the resin had high tackiness and the toner adhesion was not suppressed.

Example 46

Manufacture of Elastic Roller

A kneaded rubber composition A was obtained by mixing the materials whose kinds and amounts are shown below with the use of a pressurized kneader.

NBR rubber (product name: Nipol DN219, manufactured by ZEON CORPORATION), 100.0 parts by mass Carbon black (product name: TOKABLACK #4300, manufactured by Tokai Carbon Co., Ltd.), 40.0 parts by mass Calcium carbonate (product name: NANOX #30, manufactured by MARUO CALCIUM CO., LTD.), 20.0 parts by mass Stearic acid (product name: Stearic acid S, manufactured by Kao Corporation), 1.0 parts by mass In addition, 166.0 parts by mass of the kneaded rubber composition A and the materials whose kinds and amounts are shown below were mixed with the use of an open roll and thus, an unvulcanized rubber composition was prepared.

Sulfur (product name: Sulfax 200S, manufactured by Tsurumi Chemical Industry Co., ltd.), 1.2 parts by mass Tetrabenzylthiuram disulfide (product name: TBZTD, manufactured by SANSHIN CHEMICAL INDUSTRY CO., LTD.), 4.5 parts by mass A cross head extruder including a supply mechanism for an electroconductive substrate and a discharge mechanism for an unvulcanized rubber roller was prepared. To the cross head, a dice with an inner diameter of 16.5 mm was attached, the extruder and the cross head were set to 80° C., and the conveying speed of the electroconductive substrate was controlled to be 60 mm/sec. Under this condition, the unvulcanized rubber composition was supplied from the extruder, and the electroconductive substrate was coated with the unvulcanized rubber composition as an elastic layer inside the cross head. Thus, an unvulcanized rubber roller was obtained. Next, into a hot-air vulcanizing furnace at 170° C., the unvulcanized rubber roller was input and heated for 60 minutes. Thus, an unground conductive roller was obtained. After that, an end of the elastic layer was cut off and the surface of the elastic layer was ground with a rotary grind stone. Thus, an elastic roller D-2 whose diameter was 8.4 mm at a position 90 mm from the center to each side, and whose diameter was 8.5 mm at a central part was manufactured.

(Formation of Surface Layer)

The elastic roller D-2 was immersed in the coating for forming the surface layer adjusted in Example 1, so that a coating film of the coating was formed on the surface of the elastic layer of the elastic roller D-2 and dried. In a manner similar to Example 1, an electrophotographic roller according to Example 46 was manufactured. For the obtained electrophotographic roller, GC-MS analysis and $^{1}$H-NMR analysis were performed. Thus, it has been demonstrated that there are the n-tetradecylene structure derived from the polyol compound P-1, and the sulfonic acid group and the imidazolium group derived from the ionic compound IP-1.

(Evaluation of Dirt on Charging Roller)

When the surface of the charging roller has high tackiness, dirt may adhere on the surface of the charging roller depending on the use conditions. If the dirt adheres, charging the electrophotographic photosensitive member may cause a local charging failure in a dirt adhered portion. Thus, an image failure called a white spot (white dot) occurs on the image.

In view of the above, the dirt on the charging roller was evaluated through the following procedure.

As the electrophotographic apparatus, an electrophotographic laser printer (product name: Laserjet CP4525dn, manufactured by HP Inc.) was prepared. Next, the obtained photographic roller was attached to the toner cartridge dedicated to the laser printer as the charging roller. This toner cartridge was loaded to the laser printer, and an endurance test was performed under an environment of a temperature of 30° C. and a relative humidity of 80%. In the endurance test, an intermittent image forming operation of outputting two images, stopping the rotation of a photosensitive drum completely for about three seconds, and restarting to output the images was repeated so as to output 80000 electrophotographic images. In this case, in the output image, letters of "E" with a size of 4 points were printed on a sheet of paper with a size of A4 at a coverage of 1%. After the endurance, a halftone image (an image in which horizontal lines with a width of 1 dot in a direction perpendicular to a rotating direction of the photosensitive member are drawn in the rotating direction at intervals of 2 dots) was output on a sheet of paper with a size of A4, and in the obtained image, the number of white spots with a diameter of 0.2 mm or more was checked.

Examples 47 to 50

Electrophotographic rollers according to Examples 47 to 50 were manufactured in a manner similar to Example 46 except that the coating for forming the surface layer was changed to the coating adjusted in Example 2, 7, 8, or 29, respectively. The obtained electrophotographic roller was evaluated in a manner similar to Example 46.

Comparative Example 7

An electrophotographic roller according to Comparative Example 7 was manufactured in a manner similar to Example 46 except that the coating for forming the surface layer was changed to the coating adjusted in Comparative Example 3. Then, the evaluation similar to that of Example 46 was performed. The results of Examples and Comparative Example obtained from the above evaluation tests are shown in Table 9.

TABLE 9

| | Evaluation result | | | |
|---|---|---|---|---|
| | Prepolymer | Polyol | Ionic compound | Dirt on charging roller, the number of white spots |
| Example 46 | U-1 | P-1 | IP-1 | 0 |
| Example 47 | U-1 | P-1 | IP-2 | 0 |
| Example 48 | U-2 | P-2 | IP-1 | 0 |
| Example 49 | U-2 | P-2 | IP-2 | 0 |

TABLE 9-continued

| | Evaluation result | | | |
|---|---|---|---|---|
| | Prepolymer | Polyol | Ionic compound | Dirt on charging roller, the number of white spots |
| Example 50 | U-1 | P-1 | IP-9 | 10 |
| Comparative Example 7 | U-14 | P-14 | IP-1 | 121 |

In Examples 46 to 50, the urethane resin that forms the surface layer had the structure expressed by any of Structural Formula 1 to Structural Formula 4 according to the present invention. In Examples 46 to 50, the cationic structure and the anionic structure that are covalently bound to the urethane resin were used. Therefore, in Examples 46 to 50, the tackiness was reduced and the dirt on the charging roller was suppressed.

Above all, particularly in Examples 46 to 49 in which the cationic structure that is aromatic was used, the dirt on the charging roller was suppressed at higher level.

On the other hand, in Comparative Example 7 in which the structure expressed by any of Structural Formula 1 to Structural Formula 4 was not used, the resin had high tackiness and the dirt on the charging roller was not suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186668, filed Sep. 27, 2017, which is hereby incorporated by reference herein in its entirety.

What is claimed is:

1. An electrophotographic member, comprising:

an electroconductive substrate; and a surface layer, the surface layer containing resin including at least one of a urethane bond and an amide bond, and the resin having a cationic structure and an anionic structure in a molecule, wherein the resin includes at least one structure selected from the group consisting of formulae (1), (2) and (4)

$$-(CH_2-CR1=CH-CH_2)- \quad (1),$$

$$-(R2-O)- \quad (2), \text{ and}$$

$$-(R4-O-\overset{\overset{\displaystyle O}{\|}}{C}-O)- \quad (4)$$

where R1 represents a hydrogen atom or a methyl group, R2 represents an all group with 5 to 0.14 carbons, and R4 represents an alkylene group with 6 to 0.14 carbons, wherein a ratio of the number of moles of cations and anions that are not covalently bound to the resin to the total number of moles of the cationic structure and the anionic structure that are held by a covalent bond, and cations and anions that are not covalently bound to the resin is 30 mol % or less.

2. The electrophotographic member according to claim 1, wherein a ratio of the structure expressed by formulae (1), (2) and (4) to the entire mass of resin in the surface layer is 10 mass % or more.

3. The electrophotographic member according to claim 1, wherein the cationic structure includes a nitrogen-containing aromatic ring.

4. An electrophotographic member, comprising:

an electroconductive substrate; and a surface layer, the surface layer containing resin including at least one of a urethane bond and an amide bond, and the resin having a cationic structure and an anionic structure in a molecule, wherein the resin includes at least one structure selected from the group consisting of formulae (1) to (4)

$$-(CH_2-CR1=CH-CH_2)- \quad (1),$$

$$-(R_2-O)- \quad (2),$$

$$-(R3-O-\overset{\overset{O}{\|}}{C})-, \quad (3)$$

and $$-(R4-O-\overset{\overset{O}{\|}}{C}-O)- \quad (4)$$

where R1 represents a hydrogen atom or a methyl group, R2 represents an alkylene group with 5 to 14 carbons, R3 represents an alkylene group with 5 to 14 carbons, and R4 represents an alkylene group with 6 to 14 carbons, and a ratio of the number of moles of cations and anions that are not covalently bound to the resin to the total number of moles of the cationic structure and the anionic structure that are held by a covalent bond, and cations and anions that are not covalently bound to the resin is 30 mol % or less.

5. The electrophotographic member according to claim 4, wherein a ratio of the structure expressed by formulae (1) to (4) to the entire mass of resin in the surface layer is 10 mass % or more.

6. The electrophotographic member according to claim 4, wherein the cationic structure includes a nitrogen-containing aromatic ring.

* * * * *